US007686391B2

(12) United States Patent
Nakagome

(10) Patent No.: US 7,686,391 B2
(45) Date of Patent: Mar. 30, 2010

(54) COVER FOR AN INFANT SEAT

(76) Inventor: Mayumi Nakagome, 10-32, Dainohara 5-chome, Aoba-ku, Sendai-shi, Miyagi-ken, 981-0911 (JP)

( * ) Notice: Subject to any disclaimer, the term of this patent is extended or adjusted under 35 U.S.C. 154(b) by 297 days.

(21) Appl. No.: 11/785,014

(22) Filed: Apr. 13, 2007

(65) Prior Publication Data

US 2008/0252108 A1 Oct. 16, 2008

(30) Foreign Application Priority Data

Apr. 13, 2006 (JP) ..... 2006-002777
Jun. 6, 2006 (JP) ..... 2006-157888

(51) Int. Cl.
*A47C 31/00* (2006.01)

(52) U.S. Cl. ..... 297/219.12; 297/256.17

(58) Field of Classification Search ..... 297/256.17, 297/219.12

See application file for complete search history.

(56) References Cited

U.S. PATENT DOCUMENTS 5,238,293 A * 8/1993 Gibson ..... 297/229
5,829,835 A 11/1998 Rogers et al.
6,237,998 B1 * 5/2001 Aprile ..... 297/256.17 X
6,702,381 B2 * 3/2004 Endicott et al. ..... 297/256.17
7,100,982 B2 9/2006 Lundgren

FOREIGN PATENT DOCUMENTS

JP 09-030421 A 2/1997
JP 10-211880 A 4/1998

* cited by examiner

*Primary Examiner*—Anthony D Barfield
(74) *Attorney, Agent, or Firm*—Birch, Stewart, Kolasch & Birch, LLP

(57) ABSTRACT

A cover for an infant seat, comprising: (1) a flexible, bag-form main body having, in a top portion thereof, an opening for introducing therethrough an infant into the main body, and having a leg through-hole for allowing the leg of an infant to extend out of the main body, and (2) a flexible flap extending from a portion of the main body, which portion is positioned above the leg through-hole, wherein the flap has a free end, wherein when the flap is allowed to hang downwardly, the flap is engaged with the main body to close the leg through-hole, and wherein when the main body is installed on the seat in a manner such that the flap is placed on or wrapped around a support means provided on the seat for preventing the falling of an infant, the infant in the main body is prevented from directly contacting the support means.

11 Claims, 14 Drawing Sheets

COVER FOR AN INFANT SEAT

FIELD OF THE INVENTION

The present invention relates to a cover for an infant seat (hereinafter, frequently referred to as "infant seat cover"). More particularly, the present invention is concerned with a cover for an infant seat, comprising: (1) a flexible, bag-form main body having, in a top portion thereof, an opening for introducing therethrough an infant into the bag-form main body, and having a leg through-hole for the infant, and (2) a flexible flap extending from a portion of the bag-form main body, which portion is positioned above the leg through-hole, wherein when the flexible flap is allowed to hang downwardly, the flexible flap closes the leg through-hole, and wherein when the bag-form main body is installed on an infant seat in a manner such that the flexible flap is placed on or wrapped around a support means provided on the infant seat for preventing the fall of an infant, the infant in the bag-form main body is prevented from directly contacting the support means. The infant seat cover of the present invention can be advantageously used as a cover for infant seats (such as an infant seat installed on a shopping cart, and a stroller) provided in public places, such as a supermarket. Specifically, infant seats provided in public places generally have a support means for preventing an infant from falling from the seat (such as a grab bar which extends at least along a forward end of the infant seat) and, in many cases, such a support means is unsanitary. The infant seat cover of the present invention is advantageous not only in that the flap used in the infant seat cover can be used for preventing an infant seated in an infant seat from directly contacting such an unsanitary support means, but also in that the flap can also be used for closing the leg through-hole formed in the bag-form main body of the infant seat cover and, hence, the infant seat cover can also be used as a tote bag for various purposes, which can accommodate therein various articles. That is, despite the simple structure of the infant seat cover of the present invention, the above-mentioned advantages can be achieved since the flap used in the infant seat cover of the present invention serves as both a leg through-hole-closing means and a shielding means for preventing the infant in the bag-form main body from directly contacting the unsanitary support means of the infant seat. Further, due to its simple structure, the infant seat cover of the present invention also has various other advantageous, such as reduction in production cost, simplification of the production, freedom in design and portability.

BACKGROUND OF THE INVENTION

Generally, infant seats (such as an infant seat installed on a shopping cart, and a stroller) provided in public places, such as a supermarket, have a support means for preventing an infant from falling from the infant seats. Generally, such a support means has a grab bar which extends at least along a forward end of the infant seat. With respect to such infant seats, reference can be made to, for example, Unexamined Japanese Patent Application Laid-Open Specification Nos. Hei 10-211880 and 9-30421. However, in many cases, such infant seats have a problem in that the infant seats are unsanitary. Specifically, when an infant is seated in the infant seat, the infant bites and licks the above-mentioned grab bar and the like, so that the seat becomes unsanitary. Further, generally, such infant seats provided in public places are repeatedly used without being washed and, hence, an infant in the infant seat is exposed to dirt and germs which adhere to the infant seat.

For solving the above-mentioned problems, various proposals have been made. For example, U.S. Pat. No. 5,829,835 discloses a convertible combination of shopping cart seat liner and diaper bag for use as both a seat liner and a diaper bag (hereinafter, frequently referred to simply as "seat liner/diaper bag"), the convertible combination comprising: a flexible, upstanding container for accommodating therein an infant, which has two leg openings; a seat liner and diaper bag converting means; and a handle for enabling a user to readily carry the flexible, upstanding container when configured as the diaper bag. When the seat liner/diaper bag is used as a seat liner, the flexible, upstanding container prevents an infant seated in an infant seat from directly contacting the infant seat. Further, this patent document describes a pad which is used for covering the leg openings (hereinafter, referred to as "leg openings-covering pad") when the above-mentioned seat liner/diaper bag is used as a diaper bag. However, this patent document describes only one specific example of such a leg openings-covering pad, which is shown in the drawings of this patent document. In such only one specific example, a lower portion of the leg openings-covering pad is fixedly attached to an inner wall of the above-mentioned container at a portion thereof which is just below the leg openings, and an upper portion of the leg openings-covering pad is detachably attached to an inner wall of the container at a portion thereof which is just above the leg openings. The upper portion of the leg openings-covering pad is attached to the inner wall of the container by a fastening means (such as a hook and loop fastener) and, when the seat liner/diaper bag is used as a shopping car seat liner, the leg openings are uncovered by detaching the upper portion of the leg openings-covering pad. However, when the leg openings are uncovered and an infant is seated on the seat liner, the infant is caused to be seated on the fastening means, such as a hook and loop fastener, so that there is a danger that the infant seated on the fastening means feels uncomfortable or even suffers scratches. Further, even when an upper portion of the leg openings-covering pad is fixedly attached to an inner wall of the above-mentioned container at a portion thereof which is just above the leg openings, and a lower portion of the leg openings-covering pad is detachably attached to an inner wall of the container at a portion thereof which is just below the leg openings, a problem also arises in that the fastening means is caused to contact the legs of an infant seated on the seat liner. Furthermore, even when the leg openings-covering pad is attached to an outer surface of the container, problems arise in that, when the seat liner/diaper bag is used as a diaper bag, the contents of the container are likely to push the leg openings-covering pad to thereby uncover the leg openings. For avoiding this problem, it becomes necessary to use a disadvantageously complicated fastening means or a disadvantageously complicated fastening method. Further, generally, it is unlikely that a bag is used exclusively for carrying only diapers and it is of course desirable that a bag can also contain other articles than diapers. However, especially when the above-mentioned leg openings-covering pad is attached to the outer surface of the container of the seat liner/diaper bag of this patent document, the leg openings-covering pad is likely to be partially or entirely detached from the container by the deformation of the container when relatively heavy articles are accommodated in the container. For avoiding this problem, it becomes necessary to use a disadvantageously complicated fastening means or a disadvantageously complicated fastening method.

Further, U.S. Pat. No. 7,100,982 discloses a shopping cart seat cover which can be removably placed inside the extendable platform of a shopping cart for seating one or two children, which has a substantially planar padded material having a peripheral edge, which when placed inside the extendable platform, forms a seat capable of seating one or two children. The above-mentioned seat formed by the seat cover comprises a front side, a back side, a bottom side, a right side and a left side, and only the peripheral edge of the front side and the peripheral edge of the back side comprise elastic means. When the shopping cart seat cover of this patent document is placed on the above-mentioned extendable platform of a shopping cart, the elastic front and rear sides of the peripheral edge of the planar padded material are bent so that the planar padded material is formed into a seat capable of seating one or two infants thereon. In the shopping cart seat cover of this patent document, the extendable platform is fully covered by the peripheral edge of the planar padded material. Further, the above-mentioned planar padded material has two apertures for allowing the legs of one or two children to extend out from the seat, and is provided with a flap(s) capable of closing the apertures. In this patent document, the flap(s) is attached to the above-mentioned front side of the peripheral edge in substantially the same manner as in the above-mentioned U.S. Pat. No. 5,829,835. Therefore, U.S. Pat. No. 7,100,982 has the same problems as mentioned above in connection with U.S. Pat. No. 5,829,835. Furthermore, the shopping cart seat cover of this patent document has attached thereto a container for accommodating therein the planar padded material in a folded configuration. This patent document states that the shopping cart seat cover of this patent document has improved the comfort and safety of the infant(s) seated in the infant seat. However, as apparent from the structure of the shopping cart seat cover as shown in the drawings of this patent document, the shopping cart seat cover is not completely accommodated in the extendable platform of a shopping cart, but is placed on top of the extendable platform. Therefore, the shopping cart seat cover of this patent document has a problem in that it is difficult to provide a support having a height sufficient for preventing an infant from falling from the seat. If it is attempted to provide the shopping cart seat cover of this patent document with a support wall or the like, which has a sufficient height for preventing the infant from falling from the seat, the portability of the shopping cart seat cover becomes disadvantageously poor. Further, the infant seats provided on shopping carts have various sizes and various designs. However, since the shopping cart seat cover of this patent document comprises a substantially planar padded material, it is very difficult to select such an appropriate material for the planar padded material and such an appropriate design that the shopping cart seat cover of this patent document can be fittedly, stably and safely installed on top of the extendable platforms of shopping carts of various sizes and designs. In addition, when the above-mentioned shopping cart seat cover is carried, the above-mentioned planar padded material needs to be folded and accommodated in the above-mentioned container. That is, in the production of the shopping cart seat cover, it is necessary to choose such a material and a design as would be appropriate for installation on top of infant seats of various sizes and designs, and for carrying in a folded form; however, the appropriate choice of such a material and a design is very difficult. Therefore, the shopping cart seat cover of this patent document is not practical.

SUMMARY OF THE INVENTION

In this situation, the present inventor has made extensive and intensive studies with a view toward developing an infant seat cover having a leg through-hole, which has a simple structure, and, despite its simple structure, is advantageous not only in that the infant seat cover can be used for easily and surely preventing an infant from directly contacting an unsanitary support means provided on an infant seat for preventing an infant from falling from the infant seat, but also in that, when the infant seat cover is not used for covering an infant seat (e.g., after shopping using the infant seat cover for covering an infant seat provided on a shopping cart), the leg through-hole of the infant seat cover can be easily and surely closed, so that the infant seat cover can also be used as a tote bag for various purposes. As a result, it has unexpectedly been found that this objective can be attained by a cover for an infant seat, comprising: (1) a flexible, bag-form main body having, in a top portion thereof, an opening for introducing therethrough an infant into the bag-form main body, and having a leg through-hole for the infant, and (2) a flexible flap extending from a portion of the bag-form main body, which portion is positioned above the leg through-hole, wherein when the flexible flap is allowed to hang downwardly, the flexible flap closes the leg through-hole, and wherein when the bag-form main body is installed on an infant seat in a manner such that the flexible flap is placed on or wrapped around a support means provided on the infant seat for preventing the fall of an infant, the infant in the bag-form main body is prevented from directly contacting the support means.

Accordingly, it is an object of the present invention to provide an infant seat cover having a leg through-hole, which has a simple structure, and, despite its simple structure, is advantageous not only in that the infant seat cover can be used for easily and surely preventing an infant from directly contacting an unsanitary support means provided on an infant seat for preventing an infant from falling from the infant seat, but also in that, when the infant seat cover is not used for covering an infant seat (e.g., after shopping using the infant seat cover for covering an infant seat provided on a shopping cart), the leg through-hole of the infant seat cover can be easily and surely closed, so that the infant seat cover can also be used as a tote bag for various purposes.

The foregoing and other objects, features and advantages of the present invention will be apparent from the following description taken in connection with the accompanying drawings and the appended claims.

DESCRIPTION OF REFERENCE NUMERALS

Figure 1A:
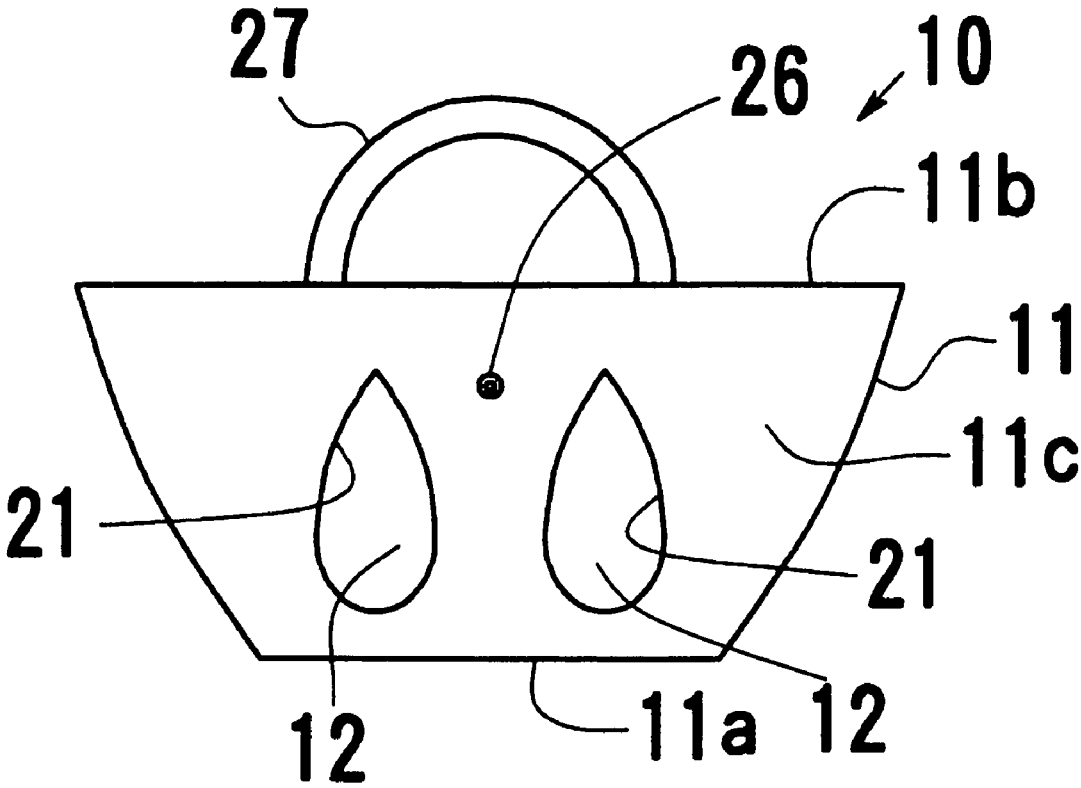
FIG. 1(*a*) is a diagrammatic front view of one embodiment of the infant seat cover of the present invention, FIG. 1(*b*) is a diagrammatic rear view of the infant seat cover shown in FIG. 1(*a*), FIG. 1(*c*) is a diagrammatic bottom view of the infant seat cover shown in FIG. 1(*a*), FIG. 2(*a*) is a diagrammatic view of an upper surface of the flexible flap of the infant seat cover shown in FIG. 1, wherein the upper surface of the flexible flap is a surface which faces upward when the flexible flap is taken out of the bag-form main body and placed on the support means extending at least along a forward end of the infant seat, FIG. 2(*b*) is a diagrammatic view of a lower surface of the flexible flap of the infant seat cover shown in FIG. 1, wherein the lower surface is a surface which faces downward when the flexible flap is taken out of the bag-form main body and placed on the support means extending at least along a forward end of the infant seat.

1: Shopping cart
2: Infant seat
3: Column of a support means for preventing an infant from falling from the infant seat
4: Grab bar of a support means for preventing an infant from falling from the infant seat
10: Cover for an infant seat
11: Flexible, bag-form main body
11*a*: Bottom of flexible, bag-form main body 11
11*b*: Opening of flexible, bag-form main body 11
11*c*: Front side of flexible, bag-form main body 11
11*d*: Rear side of flexible, bag-form main body 11
11*e*: Slit used for inserting thereinto a carrying strap of another bag accommodated in bag-form main body 11 or used for inserting thereinto a hand
12: Flexible flap
12*a*: Free end of flexible flap 12
12*b*: Bound end of flexible flap 12 (boundary between flexible flap 12 and flexible, bag-form main body 11)
12*c*: Portion of flexible flap 12, which covers a side portion of the inner surface of flexible, bag-form main body 11
12*d*: Portion of flexible flap 12, which covers a bottom portion of the inner surface of flexible, bag-form main body 11
12*e*: Lower surface of flexible flap 12, which is a surface which faces downward when flexible flap 12 is taken out of flexible, bag-form main body 11 and placed on the support means extending at least along a forward end of the infant seat
12*f*: Upper surface of flexible flap 12, which is a surface which faces upward when flexible flap 12 is taken out of flexible, bag-form main body 11 and placed on the support means extending at least along a forward end of the infant seat
21: Leg through-hole
22: Pocket
23: Slit used for securing free end 12*a* of flexible flap 12 to flexible, bag-form main body 11 when flexible flap 12 is used for closing leg through-hole 21
24: Slit for inserting thereinto a safety belt for securing an infant(s) to an infant seat
25: Female part of a snap button used as a free end-securing means
26: Male part of a snap button used as an unfolding-prevention means
27: Carrying strap attached to flexible, bag-form main body 11
27*a*: Carrying strap attached to another bag accommodated in flexible, bag-form main body 11 of the infant seat cover
28: Hook part of a hook and loop fastener used as a wrapping-securing means
29: Loop part of a hook and loop fastener used as a wrapping-securing means
30: Hanger string
31: Rubber tape used as a wrapping-securing means
31*a*: Button hole
32: Button used as a wrapping-securing means
33: Button for securing rubber tape 31 to flexible flap 12 when rubber tape 31 is not used as a wrapping-securing means
34: Width-reduced portion of flexible flap 12, which has attached thereto a free end-securing means
35: Male part of a snap button used as a free end-securing means or an unfolding-prevention means
36: Zipper used as a free end-securing means
36*a*: Loop part of a hook and loop fastener
36*b*: Hook part of a hook and loop fastener
50: Flexible, cylindrical bag wall extension of a drawstring means
51: Closable opening of bag wall extension 50
52: Drawstring
53: Hem having accommodated therein drawstring 52

DETAILED DESCRIPTION OF THE INVENTION

According to the present invention, there is provided a cover for an infant seat comprising:

(1) a flexible, bag-form main body having, in a top portion thereof, an opening for introducing therethrough an infant into the flexible, bag-form main body, and having a leg through-hole for allowing the leg of an infant to extend out of the main body therethrough, and (2) a flexible flap extending from a portion of the flexible, bag-form main body, which portion is positioned above the leg through-hole, wherein the flexible flap has a free end, wherein when the flexible flap is allowed to hang downwardly, the flexible flap is engaged with the flexible, bag-form main body, to thereby close the leg through-hole partly or completely, wherein the infant seat has a support means for preventing an infant seated in the seat from falling therefrom, and wherein when the flexible, bag-form main body is installed on the infant seat in a manner such that the flexible flap is placed on the support means or wrapped around the support means, the infant in the flexible, bag-form main body is prevented from directly contacting the support means of the infant seat.

For easier understanding of the present invention, the essential features and various preferred embodiments of the present invention are enumerated below.

1. A cover for an infant seat, comprising:

(1) a flexible, bag-form main body having, in a top portion thereof, an opening for introducing therethrough an infant into the flexible, bag-form main body, and having a leg through-hole for allowing the leg of an infant accommodated in the flexible, bag-form main body to extend out of the main body therethrough, and (2) a flexible flap extending from a portion of the flexible, bag-form main body, which portion is positioned above the leg through-hole, wherein the flexible flap has a free end, wherein, when the flexible flap is allowed to hang downwardly, the flexible flap is engaged with the flexible, bag-form main body, to thereby close the leg through-hole partly or completely, wherein the infant seat has a support means for preventing an infant seated in the seat from falling therefrom, and wherein when the flexible, bag-form main body is installed on the infant seat in a manner such that the flexible flap is placed on the support means or wrapped around the support means, the infant in the flexible, bag-form main body is prevented from directly contacting the support means of the infant seat.

2. The cover according to item 1 above, wherein the support means is in the form of a grab bar which extends at least along a forward end of the infant seat, and wherein the flexible flap is provided with a wrapping-securing means which, when the flexible flap is wrapped around the grab bar, secures the wrapping of the grab bar with the flexible flap.

3. The cover according to item 1 above, wherein the flexible flap covers the bottom of the flexible, bag-form main body, to thereby close the leg through-hole completely.

4. The cover according to any one of items 1 to 3 above, which further comprises a free end-securing means which detachably secures the free end of the flexible flap to the surface of the bag-form main body, to thereby provide a secure closure for the leg through-hole.

5. The cover according to item 4 above, wherein the free end of the flexible flap has a width-reduced portion having the free end-securing means, and wherein the flexible, bag-form main body has, on a side opposite to the side on which the leg through-hole is provided, a slit for inserting thereinto the width-reduced portion of the free end of the flexible flap, so that when the width-reduced portion having the free end-securing means is inserted into the slit and engaged with the bag-form main body, a secure closure for the leg through-hole is provided.

6. The cover according to item 1 above, which further comprises an unfolding-prevention means which, when the bag-form main body is folded, detachably secures the free end of the flexible flap to the bag-form main body, thereby preventing the bag-form main body from being unfolded.

7. The cover according to item 1 above, wherein the bag-form main body has a slit for inserting thereinto a safety belt for securing the infant to the infant seat.

8. The cover according to item 1 above, wherein the flexible flap is detachably secured to the bag-form main body.

9. The cover according to item 1 above, which further comprises at least one carrying strap, which has both ends thereof secured to the bag-form main body.

10. The cover according to item 1 above, wherein the flap is in the form of a bag.

11. The cover according to item 1 above, which further comprises a pair of backpack straps, each having ends thereof respectively secured to upper and lower portions of the bag-form main body.

12. The cover according to item 1 above, which further comprises a drawstring means for closing the opening of the bag-form main body, the drawstring means comprising:

a flexible, cylindrical bag wall extension extending upwardly from a portion of the bag-form main body, which portion is positioned above the leg through-hole, wherein the flexible, cylindrical bag wall extension has, in a top portion thereof, a closable opening, and a drawstring operably coupled to the cylindrical bag wall extension along the closable opening so that the closable opening of the cylindrical bag wall extension is closed by drawing the drawstring.

Hereinbelow, the present invention is described in detail with reference to the accompanying drawings.

Figure 1B:
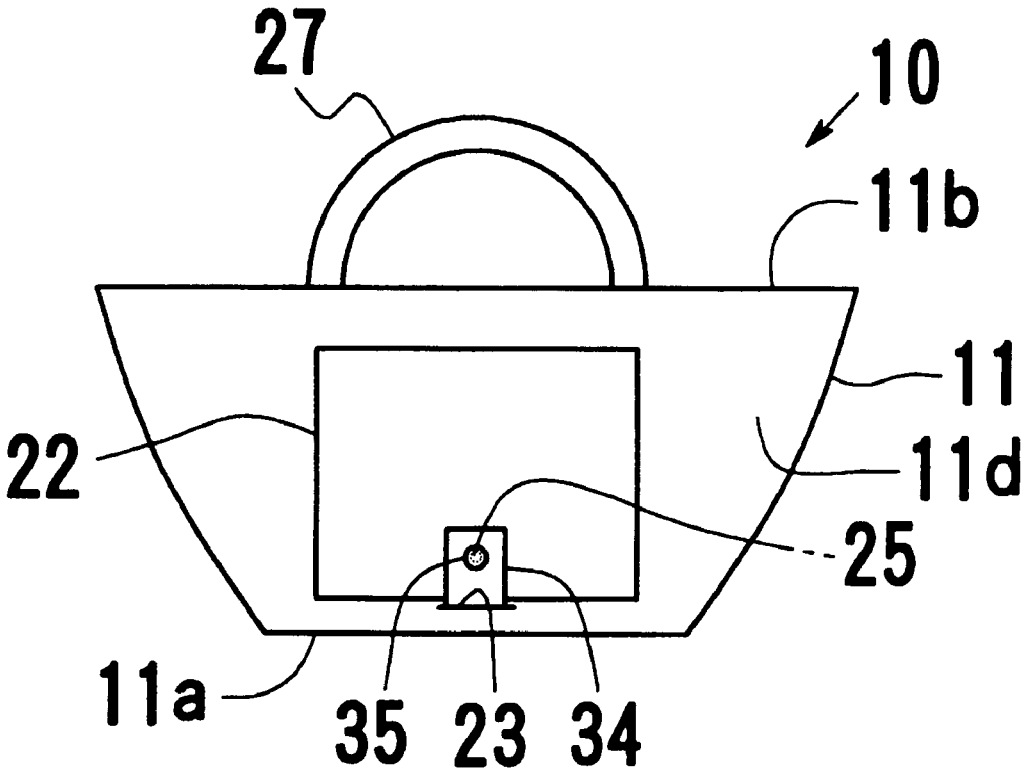
Figure 1C:
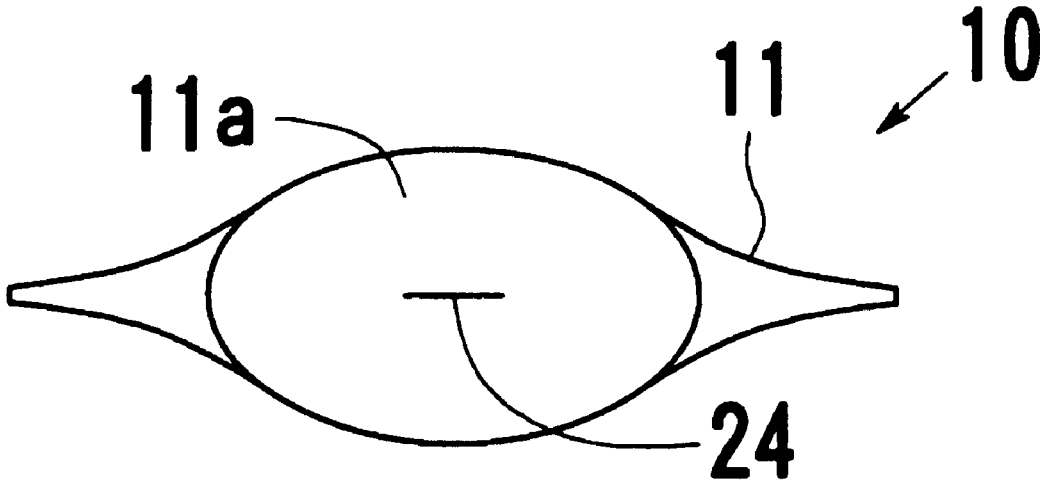

Referring to FIG. 1, there is shown a diagrammatic front view of one embodiment of the infant seat cover of the present invention. As shown in FIG. 1, the infant seat cover of the present invention comprises:

(1) a flexible, bag-form main body 11 having, in a top portion thereof, an opening 11*b* for introducing therethrough an infant into flexible, bag-form main body 11, and having a leg through-hole 21 for allowing the leg of an infant accommodated in flexible, bag-form main body 11 to extend out of main body 11 therethrough, and (2) a flexible flap 12 extending from a portion of flexible, bag-form main body 11, which portion is positioned above leg through-hole 21, wherein flexible flap 12 has a free end 12*a*.

The infant seat cover of the present invention can be readily carried and used for covering an infant seat provided in public places, such as a supermarket, which has a support means for preventing an infant from falling from the infant seat. As examples of such infant seats, there can be mentioned an infant seat installed on a shopping cart as shown in FIG. 4, an infant seat provided in a lavatory for keeping an infant during the absence of a guardian thereto, and a stroller.

Figure 4:
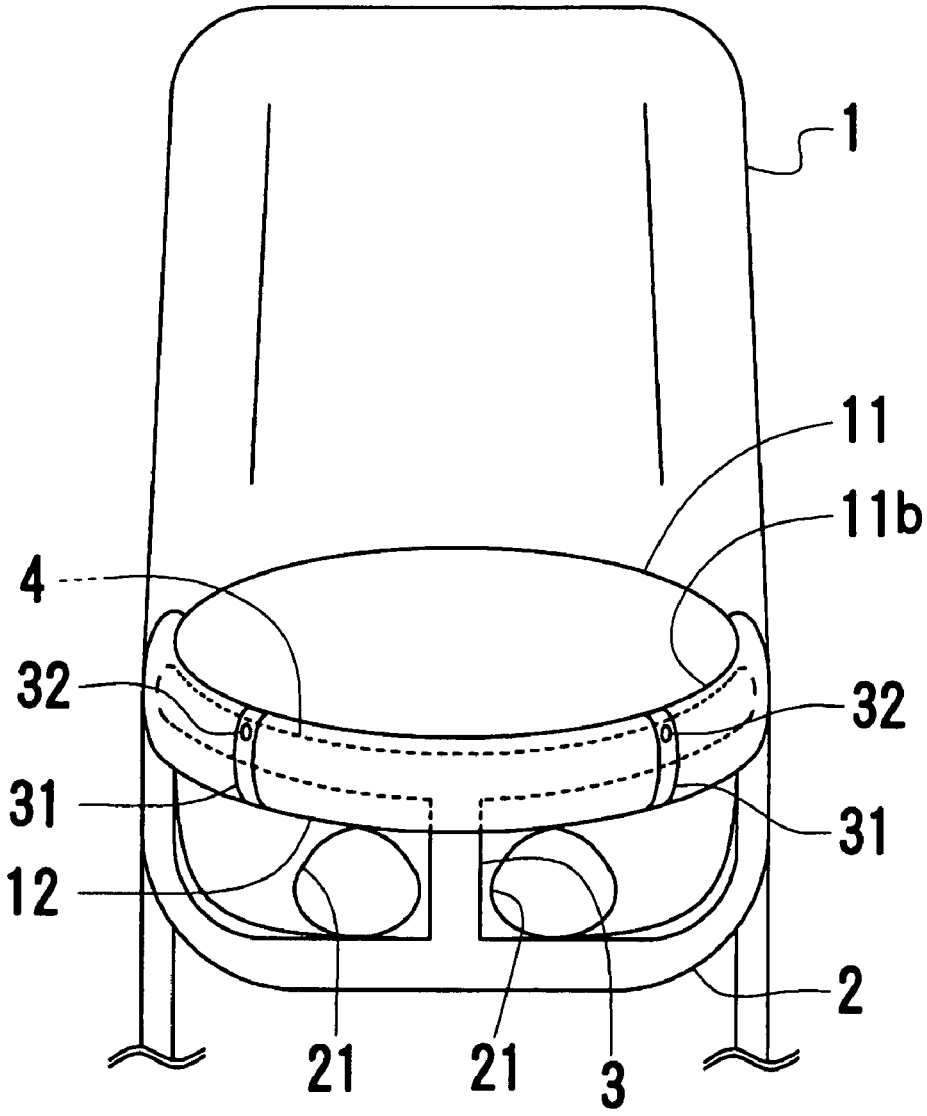
FIG. 4 is a perspective view of the infant seat cover shown in FIG. 1, which is installed on an infant seat.

Referring to FIG. 4 as well as FIG. 1, an explanation is made below as to how to use the infant seat cover of the present invention. Opening 11*b* of flexible, bag-form main body 11 of the infant seat cover is opened, and flexible flap 12 (which has been accommodated in flexible, bag-form main body 11 for closing leg through-holes 21 formed in flexible, bag-form main body 11) is taken out of bag-form main body 11 to thereby uncover leg through-holes 21. Then, the infant seat cover is placed on an infant seat 2 (having a support means comprised of a column 3 and a grab bar 4) to cover infant seat 2, and an infant is seated in infant seat 2 covered with the infant seat cover of the present invention. The above-mentioned support means of infant seat 2 generally has a space through which an infant in the seat can extend legs thereof out of the support means. Therefore, during the installation of the infant seat cover on infant seat 2, the position of leg through-holes 21 of the infant seat cover is adjusted so that the infant can extend legs thereof out of the support means of infant seat 2. After the infant seat cover has been appropriately installed on infant seat 2, the infant is put into bag-form main body 11 through opening 11*b* thereof so as to have the infant seated on the covered infant seat while allowing the infant to extend legs thereof out of bag-form main body 11 through leg through-holes 21 thereof. When the infant is seated on the covered infant seat, free end 12*a* of flexible flap 12 is extended outwardly and used to cover the support means of infant seat 2. When the support means of infant seat 2 has, as shown in FIG. 4, a grab bar 4 which extends at least along a forward end of infant seat 2, it is preferred that flap 12 is wrapped around grab bar 4.

By covering the support means (for preventing an infant from falling from the infant seat) with flexible flap 12 of the infant seat cover of the present invention, the infant seat cover of the present invention can prevent an infant from licking, biting and directly touching the support means which is generally unsanitary. Therefore, the infant seat cover of the present invention can prevent an infant from being contaminated with germs and dirt which are present on the support means, so that the infant seat can be cleanly used without the danger of contamination of the infant with germs and dirt. Further, when the infant seat cover of the present invention is used, an infant is caused to be seated on the infant seat cover installed on the infant seat. Therefore, the infant seat cover of the present invention can also prevent the infant from being contaminated with germs and dirt which are present on other portions of the infant seat than the support means. Further, the infant seat cover of the present invention is also advantageous in that the installation of the infant seat cover on the infant seat can be done simply by placing the infant seat cover on the infant seat and placing flexible flap 12 on the support means of the infant seat, and, hence, the installation can be done easily even with only one hand while holding an infant with the other hand.

In the present invention, it is preferred that the infant seat cover has at least one carrying strap 27 having both ends thereof secured to flexible, bag-form main body 11. It is more preferred that the infant seat cover has a pair of carrying straps 27, each having ends thereof respectively secured to upper portions of bag-form main body 11. By such carrying strap(s) 27, the infant seat cover of the present invention can also be used as a tote bag for various purposes when the seat cover is not used for covering an infant seat (e.g., after shopping using a shopping cart provided with an infant seat).

With respect to the material of flexible, bag-form main body 11 of the infant seat cover of the present invention, there is no particular limitation as long as it is a sheet having flexibility and does not make an infant feel uncomfortable. Various fabrics can be used as a material of bag-form main body 11, and it is especially preferred to use a quilted fabric or a canvas fabric. When any of such fabrics are used, bag-form main body 11 can be easily washed and, hence, is favorable from the viewpoint of sanity. Further, such fabrics are highly flexible, so that the installation of the infant seat cover on an infant seat is easy and that the infant seat cover can be folded up into a small form and, hence, has an advantageously high portability. The use of a quilted fabric or a canvas fabric is advantageous in that the shape of bag-form main body 11 can be easily maintained. Alternatively, the infant seat cover of the present invention may be a disposable product made of a nonwoven fabric.

With respect to the shape of flexible, bag-form main body 11, there is also no particular limitation. However, from the viewpoint of ease in introducing an infant and various articles into bag-form main body 11, it is preferred that bag-form main body 11 has a shape wherein the width of bag-form main body 11 gradually decreases from the top to bottom of bag-form main body 11 (hereinafter, such a shape is frequently referred to as "wide top shape") as shown in FIG. 1. Preferred examples of shapes of bag-form main body 11 include a trapezoid (preferably, an isosceles trapezoid), a cup shape and a hemicycle.

With respect to the dimensions of flexible, bag-form main body 11, there is also no particular limitation; however, the preferred dimensions are as follows. The height of bag-form main body 11 is preferably in the range of from 15 to 50 cm, more preferably from 20 to 40 cm, still more preferably from 25 to 35 cm. The width of bag-form main body 11 is preferably in the range of from 15 to 100 cm, more preferably from 20 to 75 cm, still more preferably from 20 to 65 cm, as measured with respect to bag-form main body 11 which is flattened by pushing bag-form main body 11 from a side having a leg through-hole(s) or a side opposite to the above-mentioned side having a leg through-hole(s). When bag-form main body 11 has a shape (such as a trapezoid, a cup shape or a hemicycle) in which the width of bag-form main body 11 varies, it is preferred that the widths measured at all portions of bag-form main body 11 are within the above-mentioned range. When bag-form main body 11 has the above-mentioned wide top shape, the width ratio of the top of bag-form main body 11 to the bottom of bag-form main body 11 is preferably in the range of from 1.2/1 to 2.5/1, more preferably from 1.3/1 to 2/1, still more preferably from 1.4/1 to 1.6/1. The thickness of a sheet used as a material of bag-form main body 11 is preferably in the range of from 0.1 to 30 mm, more preferably from 0.2 to 25 mm, still more preferably from 0.5 to 20 mm.

In the present invention, opening 11*b* of flexible, bag-form main body 11 may be closable by a zipper, a drawstring or the like. When a drawstring is used for closing opening 11*b* of bag-form main body 11, it is preferred that the infant seat cover of the present invention further comprises a drawstring means for closing opening 11*b* of bag-form main body 11. The drawstring means used in the present invention is explained below referring to FIG. 10. The drawstring means comprises:

a flexible, cylindrical bag wall extension 50 extending upwardly from a portion of bag-form main body 11, which portion is positioned above leg through-hole 21, wherein flexible, cylindrical bag wall extension 50 has, in a top portion thereof, a closable opening 51, and a drawstring 52 operably coupled to cylindrical bag wall extension 50 along closable opening 51 so that closable opening 51 of cylindrical bag wall extension 50 is closed by drawing drawstring 52.

The infant seat cover of the present invention which has the above-mentioned drawstring means is in the form of the so-called "drawstring bag". The above-mentioned bag wall extension 50 corresponds to an upper portion of a drawstring bag. When the infant seat cover having the drawstring means is used as a tote bag, closable opening 51 of bag wall extension 50 can be closed by drawstring 51. Therefore, the use of the drawstring means is advantageous in that the contents of flexible, bag-form main body 11 can be kept out of view and that it becomes possible to prevent the articles accommodated in bag-form main body 11 from falling therefrom. Further, the use of the drawstring means can prevent the stealing of the contents of flexible, bag-form main body 11 and, hence, is also advantageous from the viewpoint of security. Furthermore, when the infant seat cover having the drawstring means is used for covering an infant seat, bag wall extension 50 can be used for covering substantially all of the portions of the support means of the infant seat, which are within the reach of an infant seated in the infant seat.

The above-mentioned bag wall extension 50 is in the form of a flexible cylinder when closable opening 51 of bag wall extension 50 is fully opened and an end portion (forming the opening) of bag wall extension 50 is pulled upward. Drawstring 52 is operably coupled to bag wall extension 50 around closable opening 51 of bag wall extension 50 so that closable opening 51 can be closed by drawing drawstring 52. For example, drawstring 52 may be accommodated in hem 53 formed along closable opening 51 of bag wall extension 50. Alternatively, drawstring 52 may be inserted into a plurality of holes (not shown) formed at predetermined intervals along closable opening 51 of bag wall extension 50.

With respect to the portion of flexible, bag-form main body 11 from which bag wall extension 50 extends, there is no particular limitation as long as bag wall extension 50 extends from an upper portion of bag-form main body 11, which portion is above leg through-hole(s) 21, so that bag wall extension 50 does not hinder the functions of flexible flap 12 to close leg through-hole 21 and to prevent an infant from directly contacting the support means. It is preferred that bag wall extension 50 extends from an upper end portion of bag-form main body 11.

The length of bag wall extension 50 (i.e., height of the above-mentioned flexible cylinder) is preferably in the range of from 5 to 40 cm, more preferably from 10 to 35 cm, and still more preferably from 15 to 30 cm. Further, it is preferred that the length of bag wall extension 50 is substantially the same as the radius of opening 11*b* of bag-form main body 11 (as measured when opening 11*b* is fully opened so that opening 11*b* becomes a circle). Specifically, it is preferred that the difference between the length of bag wall extension and the radius of opening 11*b* is up to 10%, more advantageously up to 5%, based on the radius of opening 11*b*.

With respect to the material of bag wall extension 50, there is no particular limitation as long as bag wall extension is flexible enough to be easily opened by hand and be easily closed by drawing the drawstring. Examples of materials of bag wall extension 50 include a cotton fabric, a quilted fabric and a canvas fabric.

With respect to drawstring 52, there is no particular limitation, and any strings used in conventional drawstring bags can be used.

The infant seat cover of the present invention can accommodate therein at least one infant, preferably one or two infants, more preferably one infant.

With respect to the number of leg through-hole 21 formed in bag-form main body 11, bag-form main body 11 may have one leg through-hole per infant; however, it is preferred that bag-form main body 11 has two leg through-holes per infant.

With respect to the shape of leg through-hole(s) 21, there is no particular limitation, and the shape may be appropriately selected from an ellipse, a circle, a teardrop shape, a heart shape and the like. Further, when the material of bag-form main body 11 is soft, the shape of leg through-hole(s) 21 may be one having a sharp portion, such as a star shape. Needless to say, leg through-hole(s) 21 may have a decoratively designed shape, such as a shape of an animal face.

The size of leg through-hole(s) 21 is not particularly limited as long as an infant can extend legs thereof out of bag-form main body 11 through leg through-hole(s) 21. For example, when bag-form main body 11 has one leg through-hole 21 per infant, the size of leg through-hole 21 is preferably in the range of from 10 to 30 cm, preferably 12 to 27 cm, more preferably in the rage of from 15 to 25 cm, with the proviso that, when the shape of leg through-hole 21 is a circle, the above-mentioned size is the diameter of the circle, that, when the shape of leg through-hole 21 is an ellipse, the above-mentioned size is a short axis of the above-mentioned ellipse, and that, when the shape of the leg through-hole is other than a circle or an ellipse, the above-mentioned size is the shorter of the diameter of the smallest circle and the short axis of the smallest ellipse, each of which circle and ellipse can accommodate therein the above-mentioned shape other than a circle or an ellipse. Further, when bag-form main body 11 has two leg through-holes per infant, the size of each leg through-hole as defined above is preferably in the range of from 5 to 20 cm, more preferably from 6 to 17 cm, still more preferably from 7 to 15 cm.

In the present invention, the above-mentioned flexible flap 12 extends from whichever of an inner wall and an outer wall of flexible, bag-form main body 11. Further, when flexible flap 12 is used for closing leg through-hole 21, flap 12 may cover whichever of an inner wall and an outer wall of flexible, bag-form main body 11. However, for easily and surely closing leg through-hole(s) 21, it is preferred that flexible flap 12 covers the inner wall of bag-form main body 11.

Flexible flap 12 may be integrally formed with bag-form main body 11 from a single fabric by cutting and sewing thereof. Alternatively, flexible, bag-form main body 11 and flexible flap 12 may be produced by a method in which bag-form main body 11 and flexible flap 12 are separately produced as independent components of the infant seat cover and, then, coupled to each other.

Figure 3:
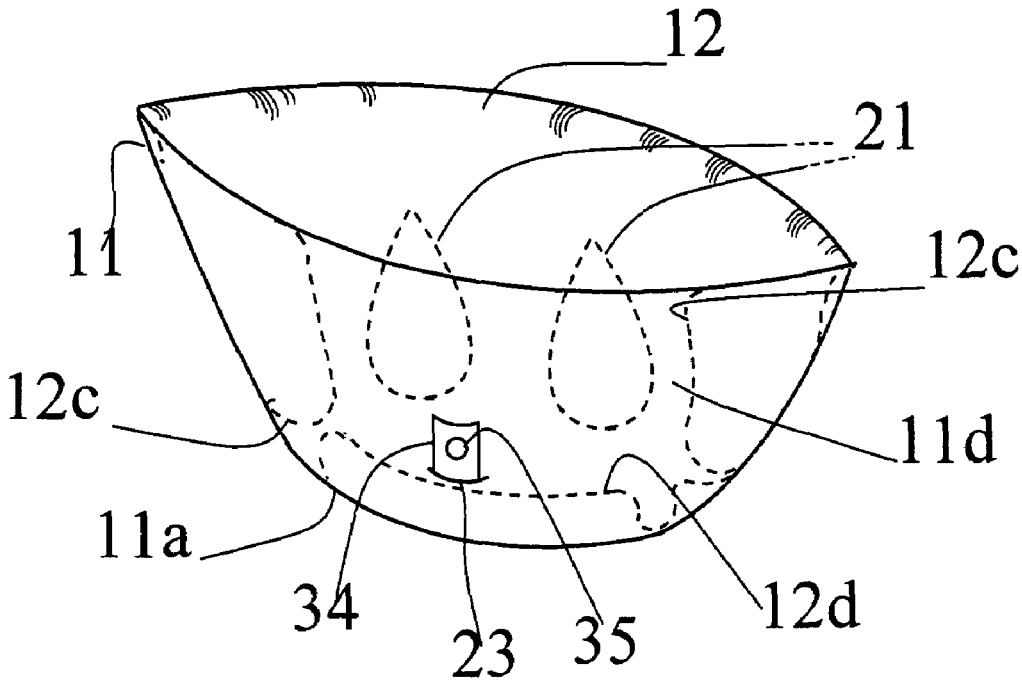
FIG. 3 is a perspective view of the infant seat cover shown in FIG. 1, in which the flap is accommodated in the bag-form main body for closing the leg through-hole (wherein some parts of the infant seat cover are omitted so as to clearly show the inside of the bag-form main body)

With respect to boundary 12*b* between flexible flap 12 and bag-form main body 11 (or bound end 12*b* of flexible flap 12, at which flap 12 is secured to bag-form main body 11), boundary 12*b* may be horizontal, curved or zigzag. However, from the viewpoint of ease in production of the infant seat cover, and ease in putting flexible flap 12 into bag-form main body 11 and taking flexible flap 12 out of bag-form main body 11, it is preferred that boundary 12*b* is horizontal as shown in FIG. 3.

There is no particular limitation with respect to the shape of flexible flap 12 as long as flap 12 can surely close leg through-hole(s) 21 and surely prevent an infant from directly contacting the support means of the infant seat. Examples of shapes of flexible flap 12 include a square, a rectangle, a trapezoid, a triangle and combinations thereof. From the viewpoint of ease in putting flexible flap 12 into bag-form main body 11 and taking flexible flap 12 out of bag-form main body 11, it is preferred that flexible flap 12 has a shape wherein the width of flap 12 is larger at boundary 12*b* (or bound end 12*b*) than at free end 12*a*. Therefore, it is preferred that the shape of flexible flap 12 is a trapezoid, a triangle, etc. Needless to say, the shape of flexible flap 12 may be a combination of different shapes, such as a combination of a larger square and a smaller square, or a combination of a rectangle and a square. As a specific preferred example of flexible flap 12, reference is made to FIGS. 2, 6 and 8 which are explained below in detail.

In the present invention, flexible flap 12 may also be in the form of a bag (hereinafter, such flexible flap 12 is referred to as "bag-form flap"). The bag-form flap is secured to an inner wall of bag-form main body 11 so that the flap, when accommodated in bag-form main body 11, has an opening at the top thereof. With respect to the shape of the bag-form flap, the shape may be the same as already mentioned above as examples of the shape of the flexible flap. The use of the bag-form flap is advantageous in that, when the bag-form flap is accommodated in bag-form main body 11 for closing leg through-hole 21 and the opening of the bag-form flap is opened, bag-form main body 11 and the bag-form flap together form a double bag structure so that leg through-hole (s) 21 can be more surely closed. In this instance, when the infant seat cover of the present invention is used as a tote bag, various articles can be accommodated in the bag-form flap without the danger of dropping articles from bag-form main body 11.

Flexible flap 12 extends from a portion of bag-form main body 11, which portion is positioned above leg through-hole (s) 21. There is no particular limitation with respect to the specific position of flexible, bag-form main body 11 from which flexible flap 12 extends as long as flexible flap 12, when used for closing leg through-hole 21, is capable of covering leg through-hole(s) 21 and, when used to cover the support means, can be easily taken out from bag-form main body 11. For example, flexible flap 12 may extend from whichever of the upper end portion of bag-form main body 11, and the inner or outer surface of bag-form main body 11 at a position which is below the upper end portion thereof. In the latter case, from the viewpoint of ease in taking out the flap 12 from bag-form main body 11 and ease in covering the support means of an infant seat with flexible flap 12, the position of bag-form main body 11 from which flexible flap 12 extends is preferably within 10 cm, more preferably 7 cm, still more preferably 5 cm, most preferably 3 cm from the uppermost portion of bag-form main body 11.

There is also no particular limitation with respect to the size of flexible flap 12 as long as flexible flap 12 is capable of covering leg through-hole(s) 21 and surely covering the support means which prevents an infant from falling from the infant seat. In the present invention, with respect to flexible flap 12 which is in a sheet form and is not in a bag form (hereinafter, referred to as "sheet-form flap"), the width of the sheet-form flap is preferably 40% to 80%, more preferably 50% to 70%, still more preferably 55% to 65%, based on the perimeter of opening 11*b* of bag-form main body 11. On the other hand, in the case of the above-mentioned bag-form flap, the perimeter of the opening of the bag-form flap is preferably 35% to less than 100%, more preferably 45% to less than 100%, still more preferably 55% to less than 100%, based on the perimeter of opening 11*b* of bag-form main body 11. Further, there is also no particular limitation with respect to the length of flexible flap 12 (i.e., maximum length of flap 12 as measured in a direction perpendicular to boundary 12*b* (or bound end 12*b*)). With respect to the sheet-form flap, the maximum length of flexible flap 12, as measured from boundary 12*b* (or bound end 12*b*) in a direction perpendicular to boundary 12*b* (or bound end 12*b*), is preferably 100% to 250%, more preferably 120% to 200%, still more preferably 140% to 180%, based on the height of bag-form main body 11.

In the present invention, it is especially preferred that the position of boundary 12*b* (or bound end 12*b*) and the length of flexible flap 12 are appropriately adjusted so that flexible flap 12 covers the bottom of bag-form main body 11, to thereby close leg through-hole 21 completely.

When the infant seat cover having a bag-form flap is used as a tote bag, there is no danger of dropping the articles accommodated in the bag through the leg through-hole(s) because the articles are accommodated in the bag-form flap. Therefore, the bag-form flap need not have a length larger than needed for the bottom of the bag-form flap to reach the inner bottom wall of bag-form main body 11. Further, when the bag-form flap is too long, the bottom portion of the bag-form flap becomes bulky at the bottom of bag-form main body 11. For these reasons, the maximum length of the bag-form flap, as measured from boundary 12*b* (or bound end 12*b*) in a direction perpendicular to boundary 12*b* (or bound end 12*b*), is preferably 70% to 200%, more preferably 80% to 160%, most preferably 90% to 110%, based on the height of bag-form main body 11.

In the present invention, as mentioned above, flexible flap 12 may be integrally formed with bag-form main body 11, or bag-form main body 11 and flexible flap 12 may be separately produced and, then, coupled to each other. In the latter case, flexible flap 12 may be fixedly secured to or detachably secured to bag-form main body 11. With respect to bag-form flap 12 which is secured to bag-form main body 11, when bound end 12*b* of the bag-form flap is too long (i.e., when a major part of the opening portion of the bag-form flap is secured to the inner wall of bag-form main body 11), the space between the inner wall of bag-form main body 11 and the bag-form flap becomes too small at the top of bag-form main body 11 to introduce an infant into bag-form main body 11. Therefore, the bag-form flap must be secured to bag-form main body 11 in a manner such that, when the infant seat cover of the present invention is used for covering an infant seat, bag-form main body 11 has a sufficient space at the top thereof for introducing an infant thereinto.

In many cases, as shown in FIG. 4, the support means of the infant seat has a grab bar 4 or the like which extends at least along a forward end of said infant seat. When the infant seat cover of the present invention is used for covering such an infant seat, it is preferred that flexible flap 12 is wrapped around grab bar 4 of the infant seat. Further, it is preferred that the infant seat cover of the present invention further comprises a wrapping-securing means which, when flexible flap 12 is wrapped around grab bar 4, secures the wrapping of grab bar 4 with flexible flap 12. By the use of the wrapping-securing means, it becomes possible to secure the wrapping of grab bar 4 with flexible flap 12 and, therefore, an infant can be safely seated in the infant seat. There is no particular limitation with respect to the wrapping-securing means as long as it is capable of securing the wrapping of grab bar 4 with flexible flap 12, and any conventional fastening means can be used. Examples of conventional fastening means include a hook and loop fastener, a button (which is fitted into a buttonhole), a pair of strings and a snap fastener. It is especially preferred that the wrapping-securing means is a hook and loop fastener (composed of a hook part and a loop part), wherein one part of the fastener is attached to the end portion of free end 12*a* of flexible flap 12 at a lower surface thereof, and the other part of the fastener is attached to the outer surface of bag-form main body 11 or the base portion of flexible flap 12 (i.e., portion which is in the vicinity of boundary 12*b* or bound end 12*b* of flap 12) at a lower surface thereof. The above-mentioned lower surface of flexible flap 12 is a surface which faces downward when flexible flap 12 is taken out of bag-form main body 11 and placed on the support means provided on the infant seat.

When flexible flap 12 is used for closing the leg through-hole(s) of bag-form main body 11, it becomes possible to accommodate various articles in bag-form main body 11 without a danger of dropping the articles through leg through-hole(s) 21.

Figure 2A:
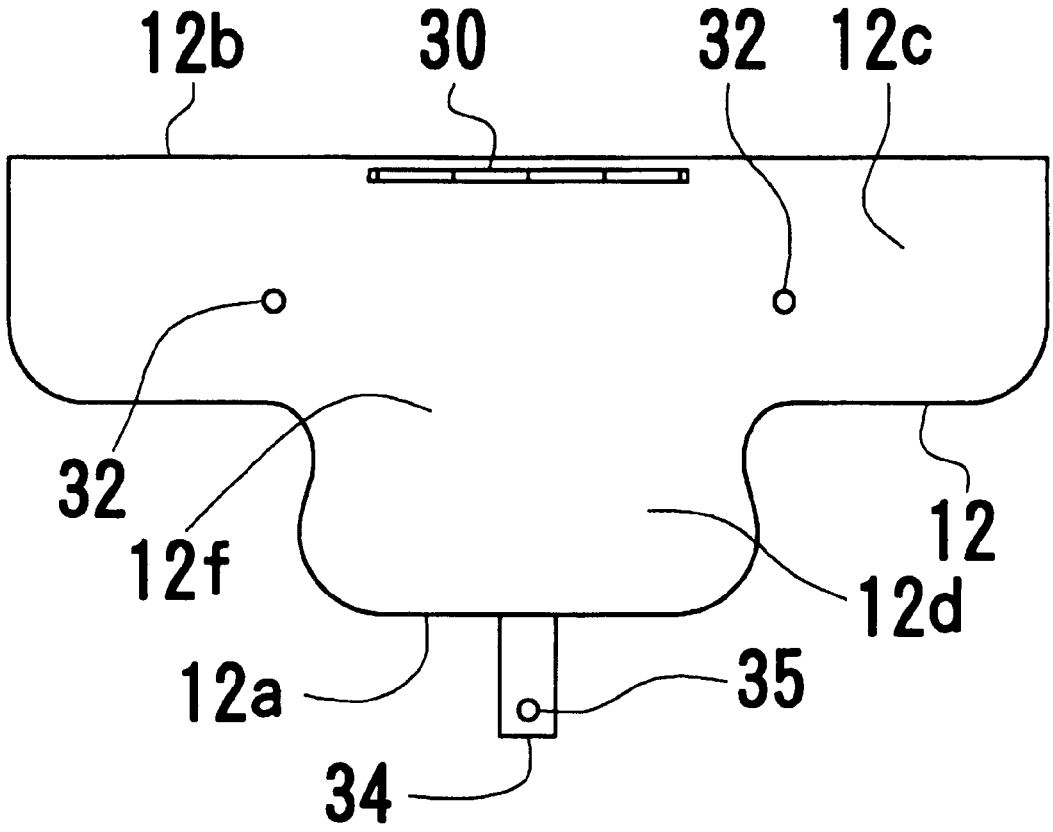
Figure 2B:
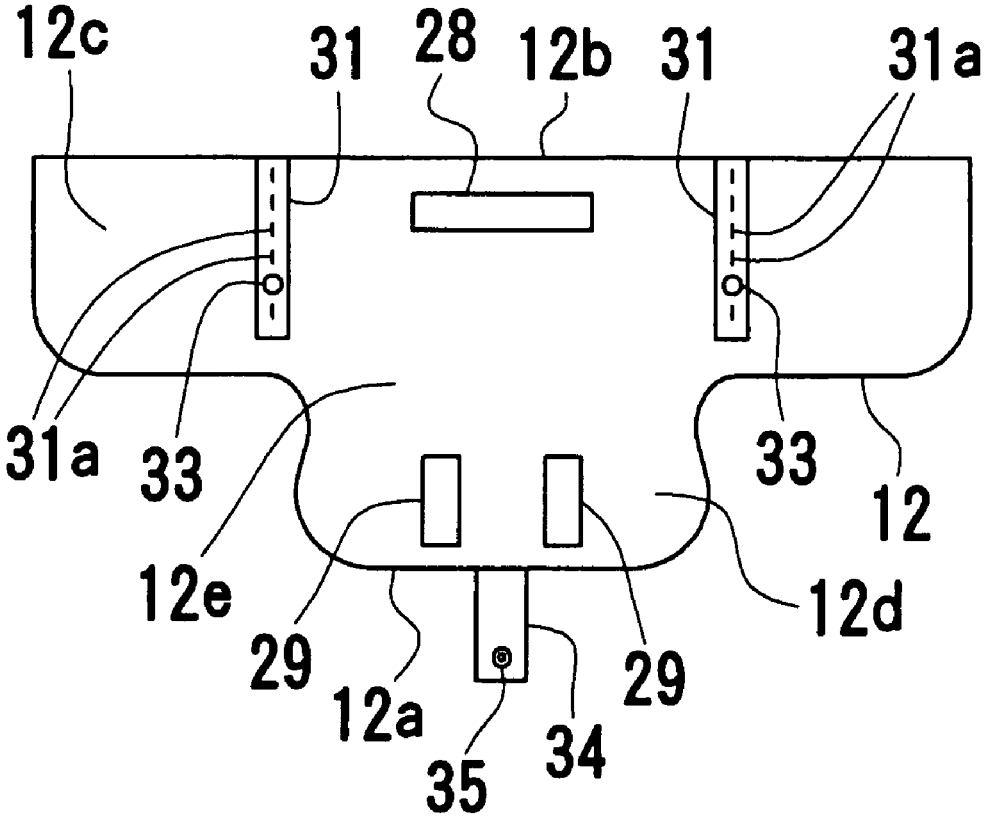

In the present invention, it is preferred that the infant seat cover of the present invention further comprises a free end-securing means which detachably secures free end 12*a* of flexible flap 12 to the surface of flexible, bag-form main body 11, to thereby provide a secure closure for leg through-hole(s) 21. It is especially preferred that flexible flap 12 covers the inner or outer bottom surface of bag-form main body 11 as well as leg through-hole(s) 21 and has the above-mentioned free end-securing means. When the infant seat cover has such flexible flap 12 having the free end-securing means, it becomes possible to securely close the leg through-hole(s), thereby preventing the articles accommodated in bag-form main body 11 from dropping through leg through-hole(s) 21. Further, by the use of the free end-securing means, it becomes possible to prevent the moving of flexible flap 12 to suppress the jumbling of the articles in bag-form main body 11 and to prevent the leg through-hole(s) from being uncovered. There is no particular limitation with respect to the free end-securing means as long as it is capable of securing the closure of the leg through-hole(s) by flexible flap 12, and any conventional fastening means can be used. Examples of conventional fastening means include a hook and loop fastener, a button (which is fitted into a button hole), a pair of strings and a snap fastener. Further, there is no particular limitation with respect to the specific structure of the infant seat cover having the free end-securing means. For example, there can be mentioned a structure as shown in FIGS. 1 and 2, wherein free end 12*a* of flexible flap 12 has a width-reduced portion 34 having the free end-securing means, and wherein flexible, bag-form main body 11 has, on a side opposite to the side on which leg through-hole(s) 21 is provided, a slit 23 for inserting thereinto width-reduced portion 34 of free end 12*a* of flexible flap 12, so that when width-reduced portion 34 having the free end-securing means is inserted into slit 23 and engaged with bag-form main body 11, a secure closure for leg through-hole (s) 21 is provided.

Figure 5:
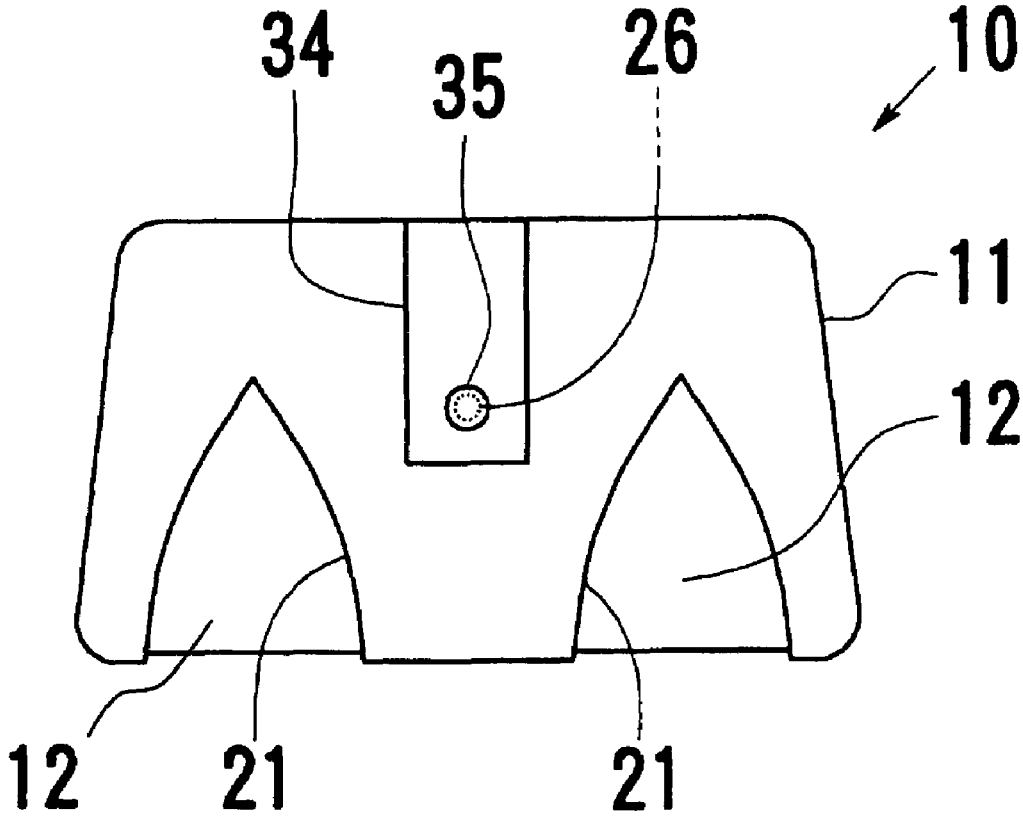
FIG. 5 is a diagrammatic front view of the infant seat cover shown in FIG. 1, which is in a folded form.

In the present invention, it is preferred that the infant seat cover further comprises an unfolding-prevention means which, when flexible, bag-form main body 11 is folded, detachably secures free end 12*a* of flexible flap 12 to flexible, bag-form main body 11, thereby preventing bag-form main body 11 from being unfolded. There is no particular limitation with respect to the unfolding-prevention means as long as it is capable of maintaining flexible, bag-form main body 11 in a folded form, and any conventional fastening means can be used. Examples of conventional fastening means include a hook and loop fastener, a button (which is fitted into a button hole), a pair of strings and a snap fastener. Further, there is no particular limitation with respect to the specific structure of the infant seat cover having the unfolding-prevention means. For example, there can be mentioned a structure as shown in FIGS. 1, 2 and 5, which utilizes the above-mentioned free end 12*a* which has width-reduced portion 34 having free end-securing means 35, and the above-mentioned slit 23 formed in bag-form main body 11. Specifically, free end-securing means 35 can be utilized as the unfolding-prevention means as follows. After closing leg through-hole(s) 12 with flexible flap 12 and inserting width-reduced portion 34 of flexible flap 12 into the above-mentioned slit 23 (formed in flexible, bag-form main body 11 on a side opposite to the side on which leg through-hole(s) 21 is provided) to thrust width-reduced portion 34 to the outside of bag-form main body 11, opening 11*b* of bag-form main body 11 is closed and bag-form main body 11 is folded, followed by securing the unfolding-prevention means 35 provided on width-reduced portion 34 to another unfolding-prevention means 26 provided on the outer surface of bag-form main body 11. When the infant seat cover has such a structure, it becomes possible to fold up the infant seat cover into a small form as shown in FIG. 5, thereby improving the portability of the infant seat cover. In this case, it is preferred that unfolding-prevention means 35 provided on width-reduced portion 34 and unfolding-prevention means 26 provided on the outer surface of flexible, bag-form main body 11 are: male and female parts of a snap fastener; hook and loop parts of a hook and loop fastener; or a button and a buttonhole.

In the present invention, flexible, bag-form main body 11 may have at least one slit 24 for inserting thereinto a safety belt for securing the infant(s) to the infant seat. There is no particular limitation with respect to the position of slit 24 and, for example, slit 24 can be formed at the bottom portion of bag-form main body 11 as shown in FIG. 1(*c*) and/or on a side of flexible, bag-form main body 11 which is opposite to the side on which leg through-hole(s) 21 is provided. When the infant seat cover has such at least one slit 24 for receiving the safety belt, an infant seated on an infant seat covered with the infant seat cover of the present invention can be secured to the infant seat by a method in which an infant seat (such as a stroller) having a safety belt is covered with the infant seat cover of the present invention; an infant is seated on the infant seat covered with the infant seat cover of the present invention; the safety belt of the infant seat is inserted into bag-form main body 11 through slit 24; and the safety belt is fastened around the body of the infant in the infant seat, thereby securing the infant to the infant seat. Thus, the above-mentioned slit 24 enables the utilization of a safety belt attached to an infant seat in combination with the infant seat cover of the present invention and, as a result, an infant can be safely seated in the infant seat.

In the present invention, flexible flap 12 and bag-form main body 11 may be prepared as separate components, and flap 12 may be detachably secured to bag-form main body 11. In this case, only flap 12 which needs more frequent cleaning can be detached from the infant seat cover and washed for sanitization. The detachable securing of flap 12 to bag-form main body 11 may be performed by any conventional means, such as a hook and loop fastener, a button (which is fitted into a buttonhole), a pair of strings and a snap fastener.

As mentioned above, it is preferred that the infant seat cover of the present invention further comprise at least one strap 27 for carrying, which has both ends thereof fixedly secured to flexible, bag-form main body 11. The infant seat cover having at least one strap 27 can be used as a tote bag when it is not used for covering an infant seat (e.g., after shopping using the infant seat cover for covering an infant seat installed on a shopping cart). For stably carrying the infant seat cover as a tote bag, it is preferred to use a pair of straps 27 which are, respectively, secured to two opposite sides of flexible, bag-form main body 11. For example, ends of one strap 27 are secured to upper portions of bag-form main body 11 on a side thereof where leg through-hole(s) 21 is formed, and ends of the other strap 27 are secured to upper portions of flexible, bag-form main body 11 on a side thereof which is opposite to the side on which leg through-hole(s) 27 is provided.

Figure 9:
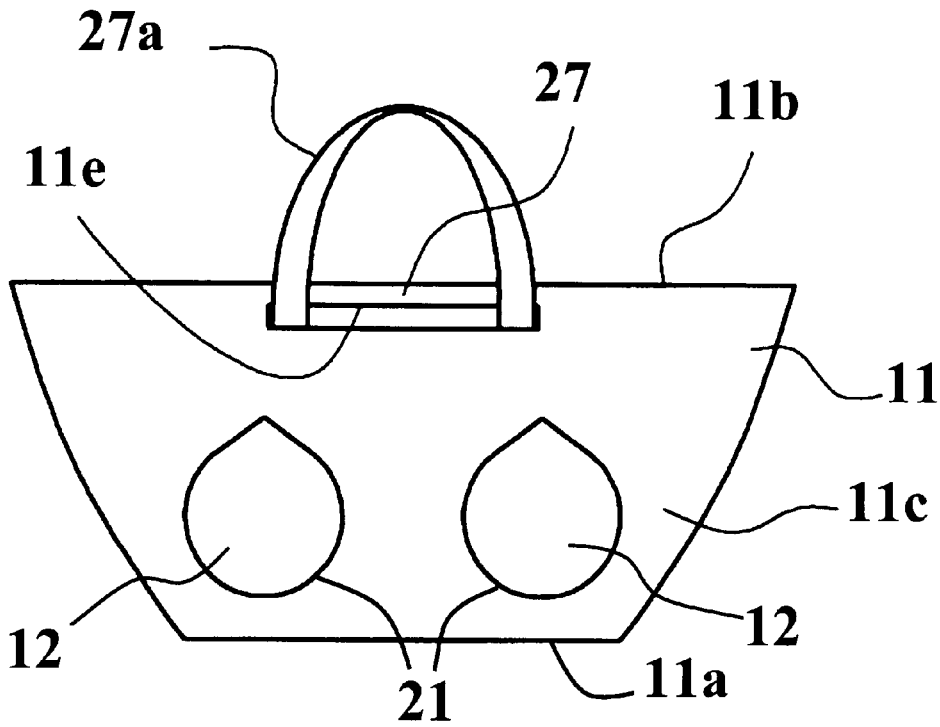
FIG. 9 is a diagrammatic front view of still a further embodiment of the infant seat cover of the present invention.

Strap(s) 27 may be prepared separately from flexible, bag-form main body 11 and, then, attached to bag-form main body 11. Alternatively, strap(s) 27 may be integrally formed at upper portions of bag-form main body 11. Specifically, bag-form main body 11 may be so designed that strap(s) 27 extends from upper portions of bag-form main body 11. Further, as shown in FIG. 9, a pair of straps 27 may be provided by forming slits 45 (or holes) for inserting a hand thereinto at upper portions of the opposite sides of bag-form main body 11, respectively, wherein portions of bag-form main body 11 above slits 45 serve as carrying straps.

Further, the infant seat cover of the present invention may further comprise a pair of backpack straps (not shown in the drawings), each having ends thereof respectively secured to upper and lower portions of bag-form main body 11. By the use of the backpack straps, the infant seat cover of the present invention can also be used as a baby carrier. Further, it is also possible to provide bag-form main body 11 with a pair of straps which can be used both as straps for hand-carrying and backpack straps, wherein the positions for securing the straps can be appropriately adjusted.

BEST MODE FOR CARRYING OUT THE INVENTION

Hereinbelow, various specific embodiments of the present invention will be described in more detail with reference to the accompanying drawings; however, they should not be construed as limiting the scope of the present invention.

Each of FIGS. 1 to 5 shows an embodiment of the infant seat cover of the present invention, and members and parts used therein. As mentioned above, the infant seat cover of the present invention can also be used as a tote bag for various purposes.

As shown in FIGS. 1 and 2, a cover 10 for an infant seat (hereinafter frequently referred to as "infant seat cover 10") comprises a flexible, bag-form main body 11 and a flexible flap 12.

As shown in FIG. 4, infant seat cover 10 can be used as a cover to be placed on an infant seat 2 installed on a shopping cart 1 provided in a supermarket or the like. Infant seat 2 has a support means for preventing an infant from falling from infant seat 2. The support means comprises a column 3 and a grab bar 4. Column 3 extends vertically so as to enable an infant seated in infant seat 2 to extend its legs out of infant seat 2 respectively on both sides of column 3. Grab bar 4 extends horizontally and is connected to the upper end of column 3 so as to prevent the infant seated in infant seat 2 from falling from infant seat 2. Infant seat cover 10 can also be used on other infant seats, such as an infant seat provided in a lavatory for keeping an infant during the absence of parents thereof and a seat portion of a stroller.

In FIG. 1, flexible, bag-form main body 11 has a bottom 11*a* having an elliptic shape and has, in an upper portion thereof, an opening 11*b*, wherein the inner diameter of flexible, bag-form main body 11 gradually increases from bottom 11*a* to opening 11*b*. Flexible, bag-form main body 11 is formed by stitching together (along stitching lines present inside of flexible, bag-form main body 11) a bottom fabric having an elliptic shape, a front fabric having a trapezoid-like shape, and a rear fabric having a trapezoid-like shape, wherein the bottom fabric forms bottom 11*a* as shown in FIG. 1(*c*), the front fabric forms front side 11*c* of flexible, bag-form main body 11, and the rear fabric forms rear side 11*d* of flexible, bag-form main body 11. The front fabric and the rear fabric have the same shape. Specifically, each of the front fabric and the rear fabric has a trapezoid-like shape in which a pair of sides which are not parallel to each other have the shape of a slightly outwardly swelling arc. The trapezoidal front fabric forming front side 11*c* of flexible, bag-form main body 11 is stitched, along the shorter base thereof, to the front peripheral portion of the bottom fabric forming bottom 11*a* of flexible, bag-form main body 11. The trapezoidal rear fabric forming rear side 11*d* of flexible, bag-form main body 11 is stitched, along the shorter base thereof, to the rear peripheral portion of the bottom fabric forming bottom 11*a* of flexible, bag-form main body 11. The front fabric and the rear fabric are stitched together so that both arc portions of the front fabric are respectively secured to both arc portions of the rear fabric. Opening 11*b* of flexible, bag-form main body 11 is formed by the respective longer bases of the trapezoidal front and rear fabrics.

As shown in FIG. 1(*a*), flexible, bag-form main body 11 has, in front side 11*c* thereof, a pair of leg through-holes 21. Each of leg through-holes 21 as shown in FIG. 1(*a*) has a teardrop shape; however, leg through-holes 21 may have a shape other than a teardrop shape, such as an elliptic shape or a circular shape. The entire periphery of each of leg through-holes 21 of flexible, bag-form main body 11 is hemmed by a method in which a fabric (not shown) is bent into a U shape and stitched to the entire periphery of each of leg through-holes 21 so that the U-shaped fabric sandwiches the entire periphery of leg through-hole 21 from both the inside and outside of flexible, bag-form main body 11. Flexible, bag-form main body 11 has a size such that an infant can be seated through opening 11*b* into flexible, bag-form main body 11 and extend its legs out of flexible, bag-form main body 11 through leg through-holes 21. Also, flexible, bag-form main body 11 has a size such that, when opening 11*b* is opened and flexible, bag-form main body 11 is placed on infant seat 2, flexible, bag-form main body 11 can cover the inside of infant seat 2.

As shown in FIG. 1(*b*), flexible, bag-form main body 11 has, on the outer surface of rear side 11*d* thereof, a pocket 22 for use as a container. Pocket 22 is formed by stitching a rectangular fabric to flexible, bag-form main body 11 so that the side portions and bottom portion of the rectangular fabric are secured to flexible, bag-form main body 11. Pocket 22 can be omitted. Flexible, bag-form main body 11 has, in rear side 11*d* thereof, a slit 23 (used for securing a free end 12*a* of flap 12), which is positioned below pocket 22. As described below, a width-reduced portion 34 (mentioned below) of free end 12*a* of flap 12 can be inserted into slit 23 from the inside to the outside of flexible, bag-form main body 11. As shown in FIG. 1(*c*), flexible, bag-form main body 11 has, in bottom 11*a* thereof, a slit 24 for inserting a safety belt for securing an infant to infant seat 2. With respect to flexible, bag-form main body 11 having the above-mentioned slits 23 and 24, portions thereof surrounding the slits are hemstitched so as to reinforce such portions surrounding the slits. Flexible, bag-form main body 11 has, in a lower portion of the outer surface of pocket 22, a female part 25 of a snap button used as a free end-securing means, which is positioned above slit 23. As shown in FIG. 1(*a*), flexible, bag-form main body 11 has, on the outer surface of front side 11*c* thereof, a female part 26 of a snap button used as an unfolding-prevention means, which is positioned around the middle between the upper ends of two leg through-holes 21. Flexible, bag-form main body 11 has a pair of carrying straps 27, which are respectively secured to the front and rear of flexible, bag-form main body 11 so that straps 27 are positioned opposite to each other across opening 11*b* of flexible, bag-form main body 11. By virtue of straps 27, infant seat cover 10 can also serve as a tote bag. Each of straps 27 is comprised of a long strip made of fabric, and both ends of the strip are stitched to the outer surface of flexible, bag-form main body 11 so that the strap forms an arc. Flexible, bag-form main body 11 has, on each of the inner surface of front side 11*c* thereof and the inner surface of rear side 11*d* thereof, an inside pocket (not shown) for accommodating therein various articles, such as a gauze handkerchief and a towel.

As shown in FIGS. 2 and 3, flap 12 has a free end 12*a* and a bound end 12*b*. Bound end 12*b* is stitched to the inside periphery of opening 11*b* along the entire front region and part of rear region of the inside periphery of opening 11*b*. Free end 12*a* can be put in and taken out of flexible, bag-form main body 11 through opening 11*b*. Flap 12 is secured to flexible, bag-form main body 11 so that bound end 12*b* of flap 12 is positioned above leg through-holes 21. Flap 12 has, on the side of bound end 12*b* thereof, a portion 12*c* which covers the inside surface of front side 11*c* (of flexible, bag-form main body 11) including leg through-holes 21 (hereinafter, portion 12*c* is frequently referred to as "side cover portion 12*c*"). Flap 12 also has, on the side of free end 12*a* thereof, a portion 12*d* which covers the inside surface of bottom 11*a* of flexible, bag-form main body 11 (hereinafter, portion 12*d* is frequently referred to as "bottom cover portion 12*d*"). In flap 12, side cover portion 12*c* has a larger width than bottom cover portion 12*d*, wherein the term "width" is defined as a horizontal length as viewed in FIGS. 2(*a*) and 2(*b*). The width (as defined above) of bottom cover portion 12*d* of flap 12 decreases around the boundary between side cover portion 12*c* and bottom cover portion 12*d*. All of the corners of flap 12 (except for the corners at both edges of bound end 12*b*) are round, and bottom cover portion 12*d* of flap 12 is slightly necked around the boundary area between side cover portion 12*c* and bottom cover portion 12*d*. The contour of flap 12 (shown in FIG. 2) as explained above is advantageous not only in that flap 12 can be smoothly put in and taken out of flexible, bag-form main body 11, but also in that leg through-holes 21 can be surely covered.

As shown in FIG. 2(*b*), a hook part 28 of a hook and loop fastener is stitched to a lower surface 12*e* of flap 12, at a position near bound end 12*b* of flap 12. Also, loop parts 29 of a hook and loop fastener, which can be detachably connected to the above-mentioned hook part 28, are stitched to lower surface 12*e* of flap 12, at a position in bottom cover portion 12*d* of flap 12. Flap 12 has a structure such that, after flexible, bag-form main body 11 is placed on infant seat 2, free end 12*a* of flap 12 can be pulled out of flexible, bag-form main body 11 through opening 11*b* so that flap 12 is drawn out of flexible, bag-form main body 11, and grab bar 4 (for preventing an infant from falling from infant seat 2) can be covered with flap 12. Flap 12 can be secured to grab bar 4 by an operation in which grab bar 4 is covered with flap 12, and loop parts 29 are connected to hook part 28. A hanger string 30 is stitched to an upper surface 12*f* of flap 12 so as to be positioned along bound end 12*b* of flap 12. Several portions of hanger string 30 are stitched to upper surface 12*f* so that hanger string 30 forms loops for holding a pacifier or the like.

As shown in FIG. 2, flap 12 has two rubber tapes 31 used as a wrapping-securing means, two buttons 32 used as a wrapping-securing means, and two buttons 33 for securing rubber tapes 31 to flap 12 when rubber tapes 31 are not used as a wrapping-securing means. As shown in FIG. 2(*b*), one end of each of rubber tapes 31 is stitched to lower surface 12*e* of flap 12 so as to be positioned at bound end 12*b* of flap 12. The distance between the above-mentioned two rubber tapes 31 is larger than the width (i.e., horizontal length as viewed in FIG. 2(*b*)) of bottom cover portion 12*d*, and each rubber tape 31 can be stretched toward free end 12*a*. Each rubber tape 31 has a plurality of button holes 31*a* which are arranged in the longitudinal direction of the rubber tape and which are positioned in the middle of the width of the rubber tape. As shown in FIG. 2(*a*), the above-mentioned two buttons 32 used as a wrapping-securing means are stitched to upper surface 12*f* of flap 12 so as to be located at positions which respectively correspond to those of rubber tapes 31 (used as a wrapping-securing means) stitched to lower surface 12*e* of flap 12. As shown in FIG. 2(*b*), buttons 33 are stitched to lower surface 12*e* of flap 12 so as to be respectively positioned back-to-back with buttons 32 stitched to upper surface 12*f* of flap 12. As shown in FIG. 4, when it is intended to cover grab bar 4 (for preventing an infant from falling from infant seat 2) with flap 12, it can be achieved by performing an operation in which each of rubber tapes 31 on flap 12 is pulled up from under grab bar 4 to the front surface of grab bar 4 so as to wind rubber tapes 31 around grab bar 4 wrapped with flap 12, and button 32 is inserted into button hole 31*a* of rubber tape 31. Thus, after flexible, bag-form main body 11 is placed on infant seat 2, by the use of rubber tapes 31 and buttons 32, flap 12 (which has been drawn out of flexible, bag-form main body 11 through opening 11*b*) can be secured in place covering grab bar 4. As shown in FIG. 2(*b*), when flap 12 is not used to cover grab bar 4, rubber tapes 31 are secured to flap 12 using buttons 33.

As shown in FIG. 2, flap 12 has width-reduced portion 34 which has a free end-securing means for securing free end 12*a* of flap 12. Width-reduced portion 34 is made of fabric, and one end thereof is stitched to free end 12*a* of flap 12. Width-reduced portion 34 is provided on flap 12 so as to protrude from free end 12*a* of flap 12. As shown in FIG. 2(*b*), width-reduced portion 34 has, on the rear surface thereof, a male part 35 of a snap button (used as a free end-securing means or an unfolding-prevention means) which can be detachably connected to a female part 25 of a snap button (used as a free end-securing means) or a female part 26 of a snap button (used as an unfolding-prevention means). As shown in FIGS. 1(*b*) and 3, when infant seat cover 10 is not used as placed on infant seat 2, flap 12 can be retracted in position by an operation in which flap 12 is placed inside of flexible, bag-form main body 11 and used to close leg through-holes 21, and width-reduced portion 34 having thereon male part 35 of a snap button (free end-securing means of flap 12) is inserted into and through slit 23 (used for securing free end 12*a* of flap 12) to extend outwardly of flexible, bag-form main body 11, whereupon male part 35 of a snap button, extending outwardly through slit 23, is connected to female part 25 of a snap button (free end-securing means of flap 12) present on the outside surface of flexible, bag-form main body 11. Further, flap 12 can be prevented from being inadvertently removed from grab bar 4 by wrapping grab bar 4 with flap 12 and connecting male part 35 of a snap button to female part 26 of a snap button.

Next, detailed explanation is made with respect to how to use the infant seat cover of the present invention and the advantages of the infant seat cover of the present invention.

As shown in FIG. 4, infant seat cover 10 of the present invention is usually carried as a handbag (the so-called "tote bag") for various purposes, and used when an infant needs to be seated on a seat, such as infant seat 2 installed on shopping cart 1 used in shops (such as supermarkets), an infant seat provided in a lavatory for keeping an infant during the absence of a guardian thereto, or a stroller seat. Infant seat cover 10 of the present invention is usually used by a method in which infant seat cover 10 is first placed on such a seat, and then an infant is seated on infant seat cover 10. More specifically, first, opening 11*b* of flexible, bag-form main body 11 of infant seat cover 10 is opened wide so as can receive an infant therethrough, and flexible, bag-form main body 11 is placed on infant seat 2, wherein leg through-holes 21 of flexible, bag-form main body 11 are positioned so that central column (support pillar) 3 of the support means for preventing an infant from falling from the seat (hereinafter, this support means is frequently referred to as "fall prevention support means") is positioned between leg through-holes 21 of flexible, bag-form main body 11. Subsequently, an infant is held upright and seated through opening 11*b* into flexible, bag-form main body 11 so that the legs of the infant extend through leg through-holes 21 outwardly of flexible, bag-form main body 11.

After seating the infant in position as described above, free end 12*a* of flap 12 is pulled out of flexible, bag-form main body 11 through opening 11*b* so that flap 12 is drawn out of flexible, bag-form main body 11, and grab bar 4 of the fall prevention support means is covered with flap 12. Each of rubber tapes 31 (as a wrapping-securing means) is pulled up and wrapped on flap 12 covering the front surface of grab bar 4, and button 32 as a wrapping-securing means is inserted into button hole 31*a*, thereby securing flap 12 in place covering grab bar 4. In addition, for improving the securing of flap 12 on grab bar 4, male part 35 of a snap button provided on width-reduced portion 34 of flap 12 may be connected to female part 26 of a snap button, provided on the front surface of flexible, bag-form main body 11. Thus, by covering grab bar 4 with flap 12, an infant can be surely prevented from biting, licking and directly contacting grab bar 4. In this way, an infant can be prevented from being contaminated with germs and dirt which are present on grab bar 4, so that infant seats installed in public places can be safely, assuredly used under sanitary conditions. Further, in the present invention, an infant is seated on infant seat 2 not directly but indirectly through flexible, bag-form main body 11 placed under the hip of the infant, so that an infant can also be prevented from being contaminated with the germs and dirt which are present on infant seat 2.

Further, since flap 12 is secured in place covering grab bar 4 by using rubber tapes 31 (as a wrapping-securing means) and buttons 32 (as a wrapping-securing means), flap 12 is unlikely to be accidentally removed from grab bar 4 by, e.g., the playful hands of an infant. Thus, an infant can be surely protected from the germs and dirt which are present on grab bar 4 of infant seat 2, so that an infant can be safely, assuredly seated on an infant seat installed in a public place.

When an infant is seated in flexible, bag-form main body 11 placed on infant seat 2, the infant may be let play with toys disposed in pocket 22 or with pacifiers or the like held by hanger string 30, thereby preventing the infant from being bored during the moving of the infant accompanied by the guardian thereto or during the shopping by the guardian.

Flap 12 is secured to an upper portion of flexible, bag-form main body 11, which is positioned above leg through-holes 21 of flexible, bag-form main body 11. By virtue of such securing position, flap 12 can be easily put in and taken out of flexible, bag-form main body 11 through opening 11*b*. Therefore, infant seat cover 10 can be suitably used by an easy "one-hand-operation" in which the installation of infant seat cover 10 on infant seat and the subsequent installation of flap 12 on grab bar 4 of the fall prevention support means are done by one hand, all while holding an infant by the other hand. As shown in FIG. 3, when infant seat cover 10 is not used as placed on infant seat 2, flap 12 is placed in the inside of flexible, bag-form main body 11 and used to close leg through-holes 21, and width-reduced portion 34 having thereon male part 35 of a snap button (free end-securing means of flap 12) is inserted into and through slit 23 (used for connecting free end 12*a* of flap 12 to flexible, bag-form main body 11) to extend outwardly of flexible, bag-form main body 11, whereupon male part 35 of a snap button, extending outwardly through slit 23, is connected to female part 25 of a snap button (free end-securing means of flap 12) present on the outside surface of flexible, bag-form main body 11. By this measure, various articles can be safely accommodated in the inside of flexible, bag-form main body 11 without the danger that articles accommodated in flexible, bag-form main body 11 drop out of flexible, bag-form main body 11 through leg through-holes 21.

The material of each of flexible, bag-form main body 11 and flap 12 is not particularly limited as long as the object of the present invention can be achieved. However, it is preferred that flexible, bag-form main body 11 and flap 12 are made of fabric (such as a quilted fabric or a canvas fabric). When flexible, bag-form main body 11 and flap 12 are made of fabric, advantages can be obtained not only in that they can be easily washed and maintained in a sanitary condition, but also in that, by virtue of their high flexibility, infant seat cover 10 can be easily used as placed on infant seat 2. Since bottom 11*a* of flexible, bag-form main body 11 has an elliptic shape, flexible, bag-form main body 11 has a large freedom of size of infant seat 2 on which flexible, bag-form main body 11 is placed, as compared to the case of flexible, bag-form main body 11 having a rectangular shape. Further, flexible, bag-form main body 11 has female part 25 of a snap button (free end-securing means of flap 12) on the outside surface thereof, so that there is no danger that female part 25 makes an infant (seated on the inside surface of flexible, bag-form main body 11) feel uncomfortable or suffer injury in the hip.

When infant seat cover 10 is used on a stroller having no grab bar, there may be taken a safety measure that, after infant seat cover 10 is placed on the seat portion of such a stroller, a safety belt (for securing an infant) of the stroller is inserted through slit 24 into flexible, bag-form main body 11 in which the safety belt is used for securing the infant (seated in flexible, bag-form main body 11) to infant seat 2. By this safety measure, infant seat cover 10 can be used safely on a stroller having no grab bar. Since strollers are usually used outdoors, the use of infant seat cover 10 on a stroller is advantageous not only in that an infant seated on the stroller can be maintained under sanitary conditions, but also in that the infant can be protected from the cold and dust. In addition, when infant seat cover 10 is not used for seating an infant (e.g., after shopping using the infant seat cover for covering an infant seat provided on a shopping cart), infant seat cover 10 can be used for accommodating toys and the like for an infant.

As shown in FIG. 5, infant seat cover 10 can be folded into a small size. How to fold it is as described below. First, leg through-holes 21 are closed with flap 12 in the inside of flexible, bag-form main body 11, and width-reduced portion 34 having thereon male part 35 of a snap button (unfolding-prevention means) is inserted into and through slit 23 (used for securing free end 12*a* of flap 12) to extend outwardly of flexible, bag-form main body 11. Flexible, bag-form main body 11 is pushed flat and opening 11*b* is closed. Both sides of flexible, bag-form main body 11 are folded over to the surface of the rear of flexible, bag-form main body 11. Bottom 11*a* is folded over backward to opening 11*b* of flexible, bag-form main body 11. Subsequently, width-reduced portion 34 having thereon male part 35 of a snap button (unfolding-prevention means), extending outwardly through slit 23, is folded over around opening 11*b*, and male part 35 of a snap button is connected to female part 26 of a snap button (unfolding-prevention means) present on the outside surface of flexible, bag-form main body 11. Thus, infant seat cover 10 can be held in a folded form having a small size and can be carried easily.

Flexible, bag-form main body 11 of infant seat cover 10 has carrying strap 27 and, hence, infant seat cover 10 can be used as a tote bag for accommodating therein various articles. Therefore, for example, infant seat cover 10 when used as a tote bag may be in a state in which diapers and a sheet for changing diapers thereon, are accommodated in flexible, bag-form main body 11; articles, such as gauze handkerchief and a towel, are placed in pocket 22; and pacifiers or the like are held by hanger string 30 forming loops. In addition, flexible, bag-form main body 11 may contain an inner bag which is used for accommodating articles which are usually carried about, so that all articles which need to be carried can be put together and held in flexible, bag-form main body 11. Needless to say, the pattern and color of flexible, bag-form main body 11 may be appropriately changed according to various conditions, such as the gender of the user of infant seat cover 10. It is not necessary to always use any of width-reduced portion 34 having thereon male part 35 of a snap button (free end-securing means of flap 12), female part 25 of a snap button (free end-securing means of flap 12), and rubber tapes 31. Further, the structures and the like of these parts may be appropriately changed in various ways in accordance with, for example, the growth stage of an infant to be seated on infant seat cover 10. Each of rubber tapes 31 has a plurality of button holes 31*a*, and specific button hole 31*a* used for receiving button 32 as a wrapping-securing means may be appropriately selected in accordance with the thickness of grab bar 4 of the fall prevention support means. The degree of strength at which flap 12 is secured, with rubber tape 31, onto grab bar 4 of the fall prevention support means can be changed by adjusting the degree of tension of elongated rubber tape 31 when button 32 as a wrapping-securing means is inserted into button hole 31*a* of rubber tape 31. Further, button holes 31*a* may also be used for holding a blanket having buttons by fitting the buttons of the blanket into button holes 31*a*.

In infant seat cover 10, bound end 12*b* of flap 12 may be detachably secured to an upper portion of flexible, bag-form main body 11 by means of a fastener or the like. In this embodiment, only flap 12, which is most likely to become dirty through use, can be detached and washed, thereby rendering it easy to maintain infant seat cover 10 in a sanitary condition.

Figure 6:
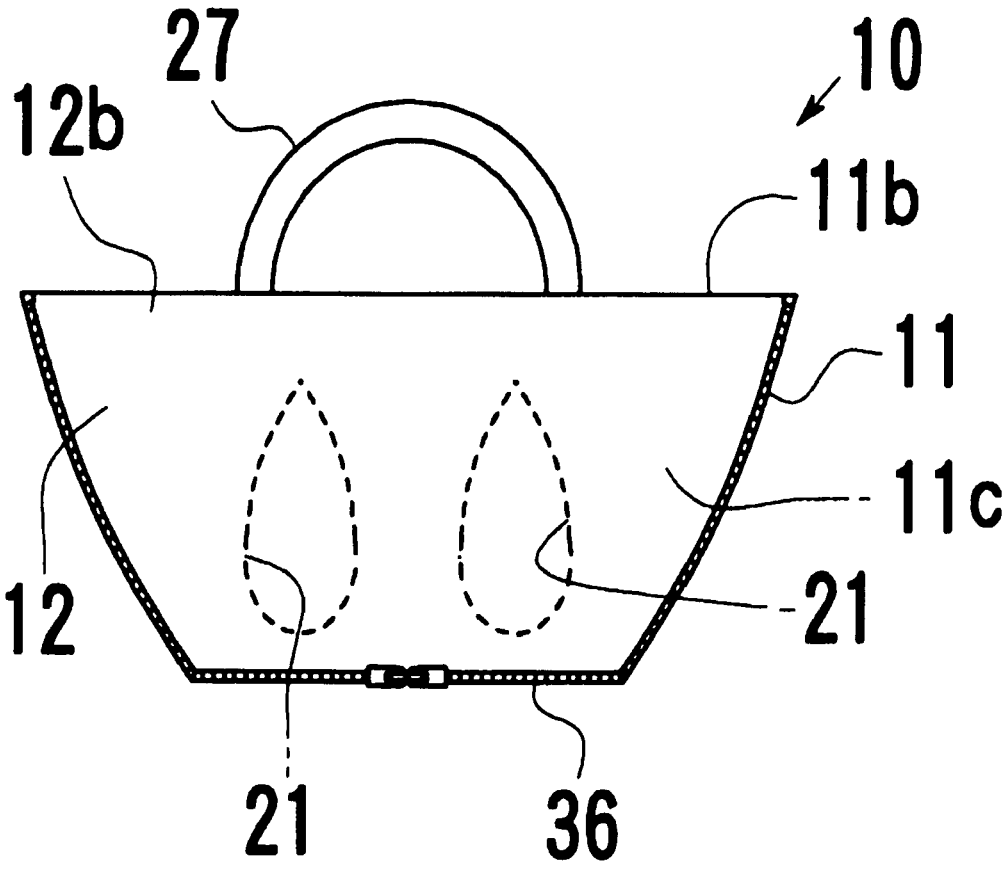
FIG. 6 is a diagrammatic front view of another preferred embodiment of the infant seat cover of the present invention.

Further, as shown in FIG. 6, bound end 12*b* of flap 12 may be secured, by stitching or the like, to the outside periphery of opening 11*b* of flexible, bag-form main body 11, instead of being secured to the inside periphery of opening 11*b* of flexible, bag-form main body 11. In this embodiment, zipper 36 is provided along the periphery of flap 12 except bound end 12*b* and along front side 11*c* of flexible, bag-form main body 11 except the periphery of opening 11*b*, thereby providing a detachable connection between these fastener-carrying portions. In this embodiment, leg through-holes 21 are covered with flap 12 in the outside of flexible, bag-form main body 11.

Figure 7:
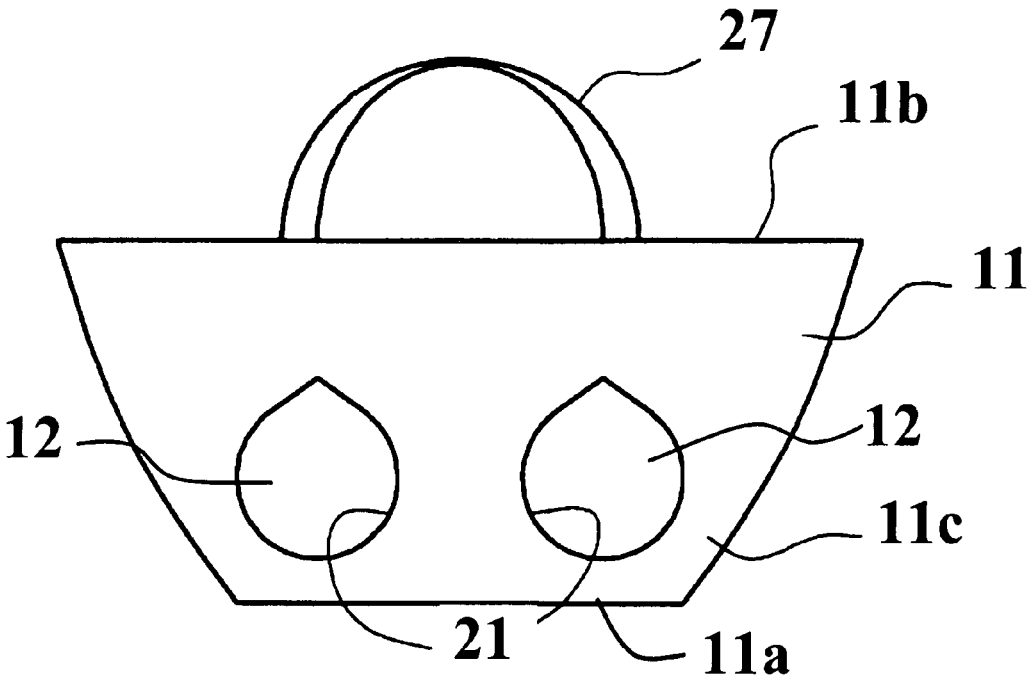
FIG. 7 is a diagrammatic front view of still another embodiment of the infant seat cover of the present invention, FIG. 8(*a*) is a diagrammatic front view of the infant seat cover shown in FIG. 7, in which the flap is taken out of the bag-form main body and extended upward, FIG. 8(*b*) is a diagrammatic rear view of the infant seat cover shown in FIG. 7, in which the flap is taken out of the bag-form main body and extended upward.
Figure 8A:
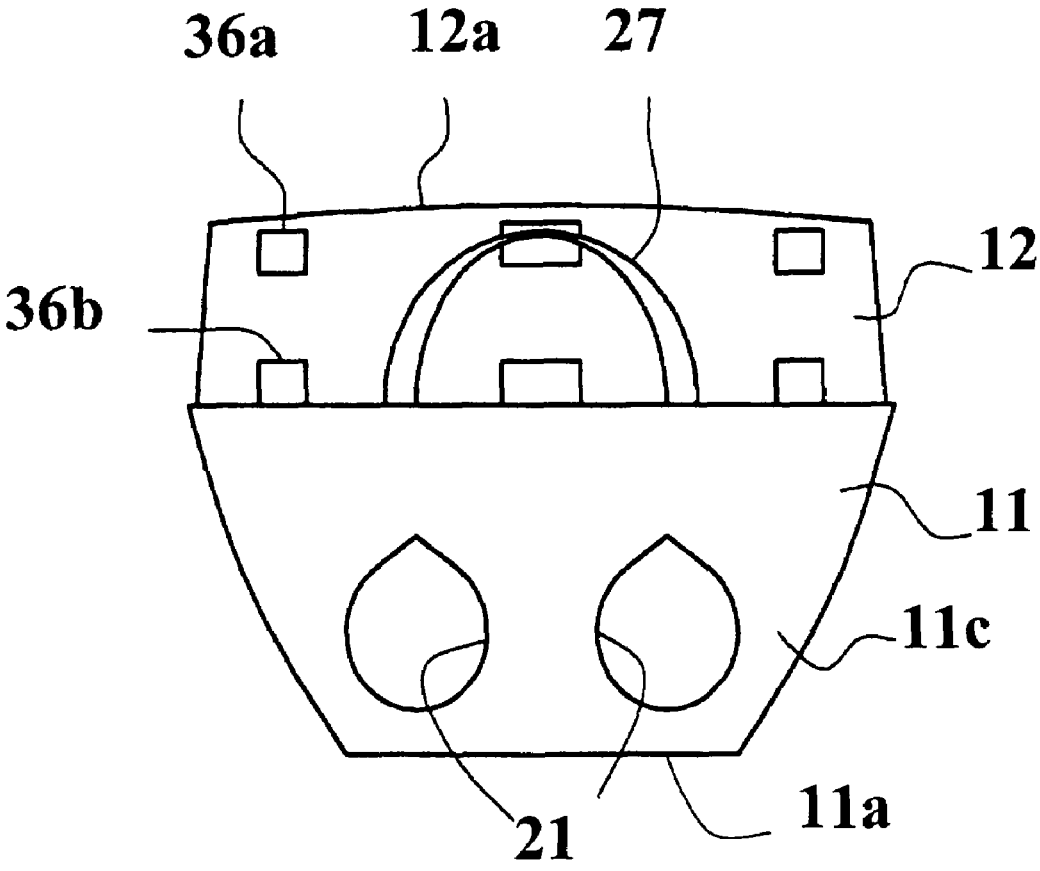
Figure 8B:
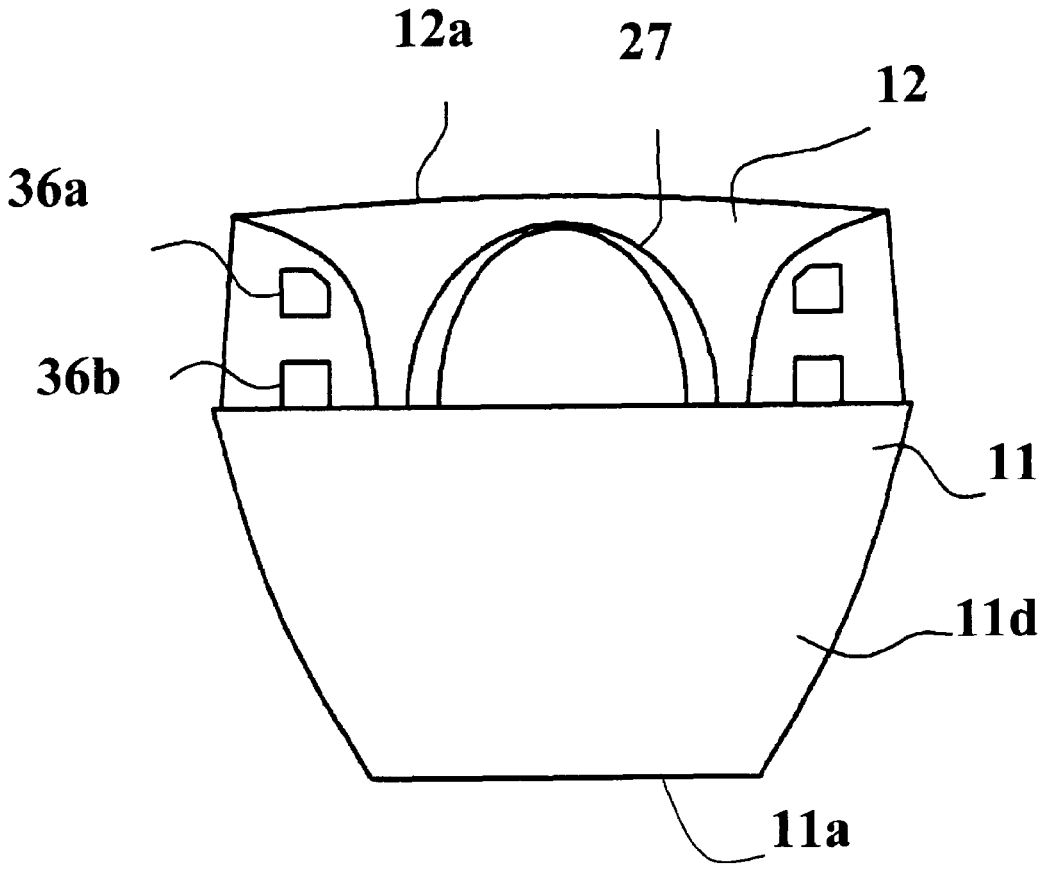

Each of FIGS. 7 and 8 shows still another embodiment of the infant seat cover of the present invention.

As shown in FIG. 7, this infant seat cover 10 (which can also be used as a tote bag) comprises flexible, bag-form main body 11 and flexible flap 12. Flexible, bag-form main body 11, which is made of fabric, has opening 11*a* at the top portion thereof and has a pair of leg through-holes 21 in the front surface thereof. Flexible, bag-form main body 11 has a size such that an infant can be seated through opening 11*a* into flexible, bag-form main body 11 so that the legs of the infant extend through leg through-holes 21 outwardly of flexible, bag-form main body 11. Also, flexible, bag-form main body 11 has a size such that, when opening 11*a* of flexible, bag-form main body 11 is opened and flexible, bag-form main body 11 is placed on infant seat 2, the inside surface of infant seat 2 is covered with flexible, bag-form main body 11 to a satisfactory extent. Flexible, bag-form main body 11 has a pair of straps 27 for carrying, which are, respectively, secured to opposite portions of the periphery of opening 11*a*. By this structure, infant seat cover 10 can be used as a tote bag.

Flap 12, which is a strip made of fabric, is secured, by stitching or the like, to the inside periphery of opening 11*a* of flexible, bag-form main body 11 along the entire front region and part of backside region of the inside periphery of opening 11*a*. The position at which flap 12 is secured to flexible, bag-form main body 11 is above leg through-holes 21 of flexible, bag-form main body 11. As shown in FIG. 7, flap 12 has a structure such that, after flexible, bag-form main body 11 is placed on infant seat 2, free end 12*a* of flap 12 can be pulled out of flexible, bag-form main body 11 through opening 11*a* so that flap 12 is drawn out of flexible, bag-form main body 11, and grab bar 4 of the fall prevention support means of infant seat 2 installed on shopping cart 1 can be covered with flap 12.

As shown in FIGS. 8(*a*) and 8(*b*), the lower surface (to be in contact with grab bar 4) of flap 12 has a plurality of hook and loop fasteners, wherein 36*a* and 36*b* respectively represent a loop part and a hook part of a hook and loop fastener. In FIGS. 8(*a*) and 8(*b*), flap 12 is depicted to have five pairs of 36*a* and 36*b*, i.e., five hook and loop fasteners. The positions of loop and hook parts can be exchanged. When flap 12 shown in FIGS. 8(*a*) and 8(*b*) is used, flap 12 is wrapped around grab bar 4 of shopping cart 1 so that the longitudinal free end of flap 12 extends along the length of grab bar 4.

Infant seat cover 10 shown in FIGS. 8(*a*) and 8(*b*) can be produced easily, thereby lowering the production cost.

With respect to infant seat cover 10 (which can be used as a tote bag) shown in FIGS. 7 and 8, instead of strap 27 (which is secured, by stitching or the like, to flexible, bag-form main body 11), slit 11*e* for forming a strap (strap 27 shown in FIG. 9) for carrying may be provided along the periphery of opening 11*b* as shown in FIG. 9. As a variation of this embodiment, infant seat cover 10 having slit 11*e* may be used in a state as shown in FIG. 9 in which flexible, bag-form main body 11 contains an inner bag having strap 27*a* which is pulled out through slit 45 so that strap 27*a* (of the inner bag) can be used for carrying infant seat cover 10.

Figure 10:
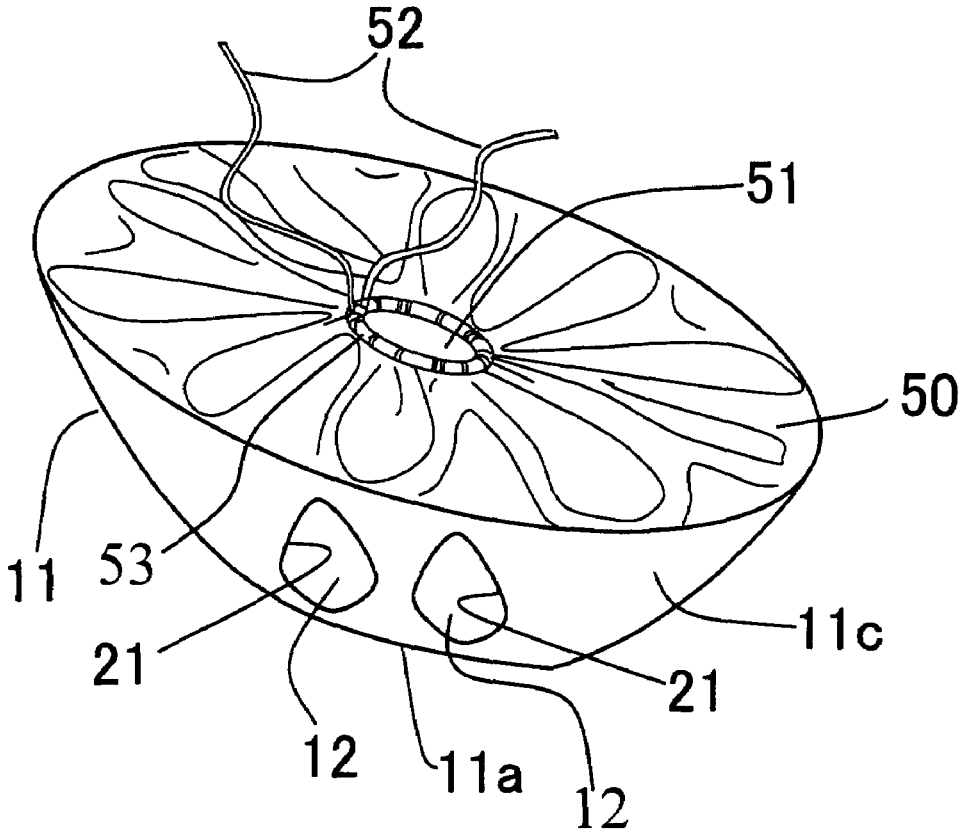
FIG. 10 is a perspective view of still a further embodiment of the infant seat cover of the present invention.

FIG. 10 shows still another embodiment of the infant seat cover of the present invention.

As shown in FIG. 10, this infant seat cover 10 has a drawstring means for closing opening 11*b* of flexible, bag-form main body 11, which drawstring means comprises:

a flexible, cylindrical bag wall extension 50 extending upwardly from a portion of bag-form main body 11, which portion is positioned above leg through-hole 21, wherein flexible, cylindrical bag wall extension 50 has, in a top portion thereof, a closable opening 51, and a drawstring 52 operably coupled to cylindrical bag wall extension 50 along closable opening 51 so that closable opening 51 of cylindrical bag wall extension 50 is closed by drawing drawstring 52.

In FIG. 10, bag wall extension 50 is a cylindrical fabric and is stitched to the upper end portion of flexible, bag-form main body 11. The diameter of this cylindrical fabric used as bag wall extension 50 is substantially the same as that of opening 11*b* of flexible, bag-form main body 11 (as measured when opening 11*b* is fully opened so that opening 11*b* becomes a circle). Further, the cylindrical fabric used as bag wall extension 50 has a height which is substantially the same as the radius of opening 11*b* of flexible, bag-form main body 11 (as measured when opening 11*b* is fully opened so that opening 11*b* becomes a circle). In FIG. 10, drawstring 52 is accommodated in hem 53 formed along the entire periphery of closable opening 51 of bag wall extension 50.

INDUSTRIAL APPLICABILITY

The infant seat cover of the present invention has a simple structure, and, despite its simple structure, is advantageous not only in that the infant seat cover can be used for easily and surely preventing an infant from directly contacting an unsanitary support means provided on an infant seat for preventing an infant from falling from the infant seat, but also in that, when the infant seat cover is not used for covering an infant seat (e.g., after shopping using the infant seat cover for covering an infant seat provided on a shopping cart), the leg through-hole(s) of the infant seat cover can be easily and surely closed, so that the infant seat cover can also be used as a tote bag for various purposes.

The invention claimed is:

1. A cover for an infant seat, comprising:

(1) a flexible, bag-form main body having, in a top portion thereof, an opening for introducing therethrough an infant into the flexible, bag-form main body, and having a leg through-hole for allowing the leg of an infant accommodated in said flexible, bag-form main body to extend out of the main body therethrough, (2) a flexible flap extending from a portion of said flexible, bag-form main body, which portion is positioned above said leg through-hole, wherein said flexible flap has a free end, and wherein, when said flexible flap is allowed to hang downwardly, the flexible flap is engaged with said flexible, bag-form main body, to thereby close said leg through-hole partly or completely, (3) a free end-securing means which detachably secures the free end of the flexible flap to the surface of said bag-form main body, to thereby provide a secure closure for said leg through-hole, wherein said infant seat has a support means for preventing an infant seated in the seat from falling therefrom, and wherein when said flexible, bag-form main body is installed on said infant seat in a manner such that said flexible flap is placed on said support means or wrapped around said support means, the infant in said flexible, bag-form main body is prevented from directly contacting the support means of the infant seat.

2. The cover according to claim 1, wherein said support means is in the form of a grab bar which extends along and above at least in front of a forward end of said infant seat, and wherein said flexible flap is provided with a wrapping-securing means which, when the flexible flap is wrapped around said grab bar, secures the wrapping of the grab bar with the flexible flap.

3. The cover according to claim 1, wherein said flexible flap covers the bottom of said flexible, bag-form main body, to thereby close said leg through-hole completely.

4. The cover according to claim 1, wherein the free end of said flexible flap has a width-reduced portion having said free end-securing means, and wherein said flexible, bag-form main body has, on a side opposite to the side on which said leg through-hole is provided, a slit for inserting thereinto said width-reduced portion of the free end of the flexible flap, so that when said width-reduced portion having the free end-securing means is inserted into said slit and engaged with said bag-form main body, a secure closure for said leg through-hole is provided.

5. The cover according to claim 1, which further comprises an unfolding-prevention means which, when said bag-form main body is folded, detachably secures said free end of the flexible flap to said bag-form main body, thereby preventing the bag-form main body from being unfolded.

6. The cover according to claim 1, wherein said bag-form main body has a slit for inserting thereinto a safety belt for securing said infant to said infant seat.

7. The cover according to claim 1, wherein said flexible flap is detachably secured to said bag-form main body.

8. The cover according to claim 1, which further comprises at least one carrying strap, which has both ends thereof secured to said bag-form main body.

9. The cover according to claim 1, wherein said flap is in the form of a bag.

10. The cover according to claim 1, which further comprises a pair of backpack straps, each having ends thereof respectively secured to upper and lower portions of the bag-form main body.

11. The cover according to claim 1, which further comprises a drawstring means for closing said opening of the bag-form main body, said drawstring means comprising:

a flexible, cylindrical bag wall extension extending upwardly from a portion of said bag-form main body, which portion is positioned above said leg through-hole, wherein said flexible, cylindrical bag wall extension has, in a top portion thereof, a closable opening, and a drawstring operably coupled to said cylindrical bag wall extension along said closable opening so that the closable opening of the cylindrical bag wall extension is closed by drawing the drawstring.

* * * * *